US009285128B2

(12) United States Patent
Takata et al.

(10) Patent No.: US 9,285,128 B2
(45) Date of Patent: Mar. 15, 2016

(54) AIR-CONDITIONING APPARATUS WITH MULTIPLE OUTDOOR, INDOOR, AND MULTIPLE RELAY UNITS

(75) Inventors: Shigeo Takata, Chiyoda-ku (JP); Koji Yamashita, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 33 days.

(21) Appl. No.: 13/579,495

(22) PCT Filed: Mar. 16, 2010

(86) PCT No.: PCT/JP2010/001882

§ 371 (c)(1),
(2), (4) Date: Aug. 16, 2012

(87) PCT Pub. No.: WO2011/114368

PCT Pub. Date: Sep. 22, 2011

(65) Prior Publication Data

US 2012/0297812 A1 Nov. 29, 2012

(51) Int. Cl.

| | |
|---|---|
| ***F25B 13/00*** | (2006.01) |
| ***F24F 1/68*** | (2011.01) |
| ***F25B 25/00*** | (2006.01) |

(52) U.S. Cl.

CPC . *F24F 1/68* (2013.01); *F25B 13/00* (2013.01); *F25B 25/005* (2013.01);

(Continued)

(58) Field of Classification Search

CPC ..... F25B 13/00; F25B 25/005; F25B 2313/0231; F25B 2313/0272

USPC ..... 62/204, 222, 324.6

See application file for complete search history.

(56) References Cited

U.S. PATENT DOCUMENTS 4,720,982 A * 1/1988 Shimizu et al. ..... 62/204
5,123,255 A * 6/1992 Ohizumi ..... 62/175

(Continued)

FOREIGN PATENT DOCUMENTS

CN 1114406 A 1/1996
JP 58-46027 U 3/1983

(Continued)

OTHER PUBLICATIONS

International Search Report (PCT/ISA/210) issued on Jun. 29, 2010, by the Japanese Patent Office as the International Searching Authority for International Application No. PCT/JP2010/001882.

(Continued)

*Primary Examiner* — Jonathan Bradford
*Assistant Examiner* — Melanie Phero
(74) *Attorney, Agent, or Firm* — Buchanan Ingersoll & Rooney

(57) ABSTRACT

An air-conditioning apparatus includes refrigerating cycle systems each connecting a compressor for compressing a refrigerant, a refrigerant flow path switching device, a heat source side heat exchanger for exchanging heat for the refrigerant, an expansion device for adjusting the pressure of the refrigerant, and heat exchangers related to heat medium which exchanges heat between the refrigerant and heat medium different from the refrigerant, by piping so as to constitute refrigerant circuits; and heat medium side systems each connecting pumps for circulating the heat medium for the heat exchangers related to heat medium, use side heat exchangers for exchange heat between the heat medium and air of an air-conditioning target space and heat medium flow switching systems for switching the heat medium which passes through each heat exchangers related to heat medium to each use side heat exchanger, by piping so as to constitute a heat medium circulation circuit.

6 Claims, 15 Drawing Sheets

(52) U.S. Cl.
CPC *F25B 2313/0233* (2013.01); *F25B 2313/0253* (2013.01); *F25B 2313/0272* (2013.01); *F25B 2313/02732* (2013.01); *F25B 2313/02741* (2013.01)

(56) References Cited

U.S. PATENT DOCUMENTS

| | | | | |
|---|---|---|---|---|
| 5,142,879 | A * | 9/1992 | Nakamura et al. | 62/160 |
| 5,279,131 | A | 1/1994 | Urushihata et al. | |
| 5,388,422 | A * | 2/1995 | Hayashida et al. | 62/211 |
| 5,467,604 | A | 11/1995 | Sekigami et al. | |
| 5,548,968 | A * | 8/1996 | Sada | 62/175 |
| 5,630,324 | A * | 5/1997 | Yoshida et al. | 62/175 |
| 6,237,356 | B1 * | 5/2001 | Hori et al. | 62/324.1 |
| 6,779,356 | B2 * | 8/2004 | Lee et al. | 62/204 |
| 7,409,833 | B2 * | 8/2008 | Unger et al. | 62/196.2 |
| 7,464,563 | B2 * | 12/2008 | Park et al. | 62/324.6 |
| 2008/0236185 | A1 * | 10/2008 | Choi et al. | 62/332 |
| 2010/0319362 | A1 | 12/2010 | Hisaoka | |
| 2011/0083454 | A1 * | 4/2011 | Kopko | F25B 49/027 62/115 |

FOREIGN PATENT DOCUMENTS

| | | | |
|---|---|---|---|
| JP | 4-093561 | A | 3/1992 |
| JP | 05-060407 | A | 3/1993 |
| JP | 5-280818 | A | 10/1993 |
| JP | 07-004758 | A | 1/1995 |
| JP | 7-218034 | A | 8/1995 |
| JP | 7-234038 | A | 9/1995 |
| JP | 10-089742 | A | 4/1998 |
| JP | 2001-289465 | A | 10/2001 |
| JP | 2003-343936 | A | 12/2003 |
| JP | 2005-140444 | A | 6/2005 |
| JP | 2009-014280 | A | 1/2009 |
| WO | 2009/005116 | A1 | 1/2009 |
| WO | 2009/133640 | A1 | 5/2009 |
| WO | WO 2009/133644 | A1 | 11/2009 |

OTHER PUBLICATIONS

Japanese Office Action dated Sep. 24, 2013, issued by the Japanese Patent Office in corresponding Japanese Application No. 2012-505302, and an English Translation thereof. (6 pgs.).

Office Action issued on May 6, 2014, by the Chinese Patent Office in corresponding Chinese Patent Application No. 201080065428.4 and an English translation of the Office Action. (15 pages).

Office Action (Notice of Reasons for Refusal) issued on May 7, 2014, by the Japanese Patent Office in corresponding Japanese Patent Application No. 2012-505302 and an English translation of the Office Action. (7 pages).

Office Action issued on Dec. 24, 2014, by the Chinese Patent Office, in corresponding Chinese Patent Application No. 201080065428.4, and an English Translation of the Office Action. (9 pages).

* cited by examiner (a)

(b)

AIR-CONDITIONING APPARATUS WITH MULTIPLE OUTDOOR, INDOOR, AND MULTIPLE RELAY UNITS

TECHNICAL FIELD

The present invention relates to an air-conditioning apparatus applied to, for example, a multi-air-conditioning apparatus for building use.

BACKGROUND ART

Conventionally, in the air-conditioning apparatus such as a multi-air-conditioning apparatus for building use, cooling operation or heating operation is carried out by circulating a refrigerant, for example, between an outdoor unit which is a heat source unit disposed outdoors and an indoor unit disposed indoors. Specifically, cooling or heating of the air-conditioning target space was performed with air heated by heat-transferring of refrigerant or air by heat-receiving of refrigerant. As a refrigerant used for such an air-conditioning apparatus, for example, HFC (hydrofluorocarbon) based refrigerants are often used, and natural refrigerants such as carbon dioxide ($CO_2$) have been also suggested.

In the meantime, there is an air-conditioning apparatus of another construction represented by chiller system. In such an air-conditioning apparatus, cooling energy or heating energy generated in the heat source unit disposed outdoors cools or heats the heat medium (secondary refrigerant) such as water or nonfreezing fluid at a heat exchanger disposed in an outdoor unit and this heat medium is transported to a fan-coil unit or a panel heater or the like which is an indoor unit disposed in the air-conditioning target region to perform cooling or heating (for example, see Patent Literature 1).

There are air-conditioning apparatuses which are configured so that heat exchangers for the primary refrigerant and the secondary refrigerant may be disposed in the vicinity of the respective indoor units and the secondary refrigerant may be transported to the indoor unit (for example, see Patent Literature 3).

In addition, there are also air-conditioning apparatuses which are configured so that divergence units having an outdoor unit and a heat exchanger may be connected with two pipelines to transport the secondary refrigerant to the indoor unit (for example, see Patent Literature 4).

CITATION LIST

Patent Literature

Patent Literature 1: Japanese Patent Laid-Open No. 2005-140444 (page 4, FIG. 1)

Patent Literature 2: Japanese Patent Laid-Open No. H5-280818 (pages 4, 5, FIG. 1)

Patent Literature 3: Japanese Patent Laid-Open No. 2001-289465 (pages 5-8, FIG. 1, FIG. 2)

Patent Literature 4: Japanese Patent Laid-Open No. 2003-343936 (page 5, FIG. 1)

SUMMARY OF INVENTION

Technical Problem

The refrigerant is circulated to the indoor unit in an air-conditioning apparatus such as a conventional multi-air-conditioning apparatus for building use, and therefore, there is a possibility that the refrigerant leaks indoors. Therefore, as a refrigerant, only non-inflammable refrigerants were used and from the safety point of view, flammable refrigerants were not able to be used even if they have smaller global warming potential. On the other hand, the refrigerant was circulated only within the heat source unit installed outdoors in the air-conditioning apparatus described in Patent Literature 1, and the refrigerant does not pass through the indoor unit and therefore even if a flammable refrigerant is used as a refrigerant, the refrigerant never leaks indoors.

However, the circulation path of the heat medium becomes longer in the air-conditioning apparatus described in Patent Literature 1 since it is necessary to heat or cool the heat medium in a heat source unit outside the building and transport the heat medium to the indoor unit side. In order to transport the heat to perform predetermined heating or cooling operation using the heat medium, however, when the circulation path becomes longer, energy consumption by transportation power becomes significantly larger than that by the air-conditioning apparatus which transports the refrigerant to the indoor unit. From this point, it can be understood that energy can be saved in an air-conditioning apparatus if the circulation of the heat medium can be controlled well.

The air-conditioning apparatus described in Patent Literature 2 needs to have the secondary medium circulation means such as a pump for every indoor unit and therefore it was not only an expensive system but also it caused large noises, and thus it was not practical. In addition, since the heat exchanger was located near the indoor unit, it was not able to remove the risk of leaking of refrigerant indoors, and thus it was not able to use a flammable refrigerant.

The air-conditioning apparatus described in Patent Literature 3 has a constitution energetically useless since it is not able to show maximum ability in each indoor unit when plural indoor units are connected because the primary refrigerant after heat-exchange flows into the same flow path as the primary refrigerant before the heat-exchange.

The present invention has been made to solve the problem mentioned above and an object thereof is to exchange heat between the refrigerant and the heat medium and perform air-conditioning with the heat medium and to obtain an apparatus which can further improve the operation efficiency.

Solution to Problem

The air-conditioning apparatus according to the present invention comprises: refrigerating cycle systems each connecting a compressor for compressing a refrigerant, a refrigerant flow path switching device for switching the circulation path of the refrigerant, a heat source side heat exchanger for exchanging heat for the refrigerant, an expansion device for adjusting the pressure of the refrigerant, and heat exchangers related to heat medium which exchange heat between the refrigerant and heat medium different from the refrigerant to be able to make the heat medium different in temperature respectively, by piping so as to constitute refrigerant circuits; and heat medium side systems each connecting heat medium sending devices for circulating the heat medium for the heat exchangers related to heat medium, use side heat exchangers for exchanging heat between the heat medium and air of an air-conditioning target space and heat medium flow switching units for switching the heat medium which passes through heat exchangers related to heat medium to the use side heat exchangers, by piping so as to constitute a heat medium circulation circuit.

Advantageous Effects of Invention

Since the air-conditioning apparatus of the present invention connects plural refrigerating cycle systems constituting refrigerant circuits to a heat medium side system constituting a heat medium circulation circuit and enabling the respective refrigerant circuits to individually provide the heat medium circulating through the heat medium circulation circuit with cooling capacity and heating capacity and thus the apparatus can perform enhancement of the capacity easily. In addition, the capacity supplied from the respective refrigerant circuits can be shared. On this account, the most optimized operation can be performed effectively, and, for example, energetically efficient operation can be performed as a whole air-conditioning apparatus.

DESCRIPTION OF EMBODIMENTS

Embodiment 1

Figure 1:
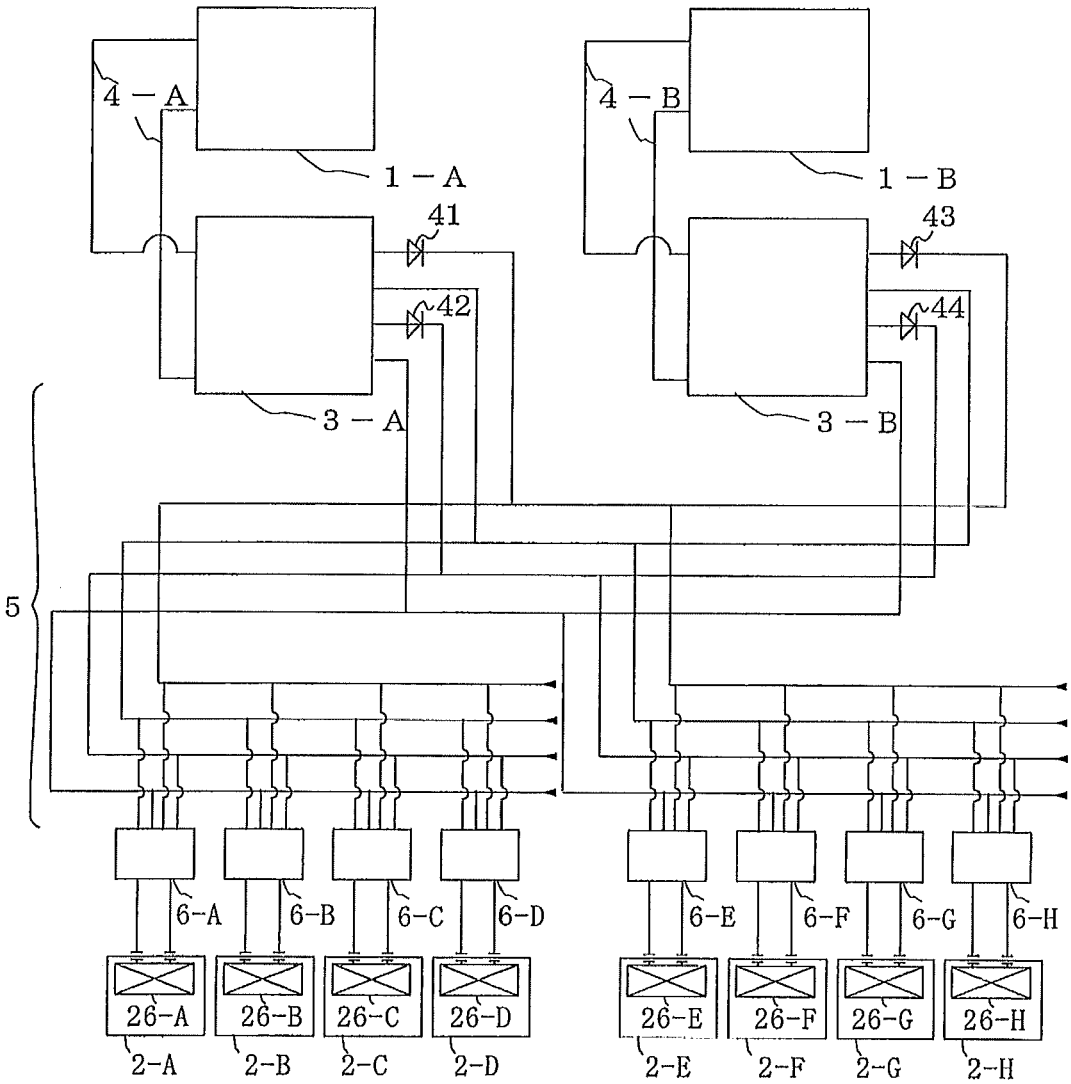
FIG. 1 is a diagram illustrating an example of the constitution of the air-conditioning apparatus according to Embodiment 1 of the present invention.

FIG. 1 is a diagram illustrating an example of the constitution of the air-conditioning apparatus according to Embodiment 1 of the present invention. In the present embodiment, a refrigerant circuit (primary refrigerant circuit) circulating a heat source side refrigerant (primary refrigerant) is constituted by connecting a heat medium relay unit 3 (heat exchanger 15*a* related to heat medium and heat exchanger 15*b* related to heat medium which the heat medium relay unit 3 has) to an outdoor unit 1 with a refrigerant piping 4 as shown in FIG. 1. The air-conditioning apparatus of FIG. 1 has two refrigerant circuit systems. On this account, it comprises two sets of the outdoor unit 1 and the heat medium relay unit 3. When describing distinguishing the unit of the respective sets in particular in the following explanation, they are referred to with a subscript as, for example, outdoor unit 1-A, outdoor unit 1-B, heat medium relay unit 3-A, heat medium relay unit 3-B.

On the other hand, a heat medium circulation circuit (secondary refrigerant circuit) circulating a heat medium (a secondary refrigerant) is constituted by connecting a heat medium relay units 3 (heat exchanger 15*a* related to heat medium and heat exchanger 15*b* related to heat medium which the heat medium relay unit 3 has) and indoor units 2 with a piping 5 via flow path switching units 6 which are provided for each indoor unit 2. In FIG. 1, two heat medium relay units 3 and eight indoor units 2-A to 2-H (flow path switching unit 6-A to 6-H) are connected by piping 5 in parallel.

As shown in FIG. 1, refrigerant circuits of plural systems are connected to heat medium circulation circuits and the operation according to air-conditioning is intended diversified thereby making the energy efficiency still better in the air-conditioning apparatus of the present embodiment.

[Outdoor Unit 1]

Figure 2:
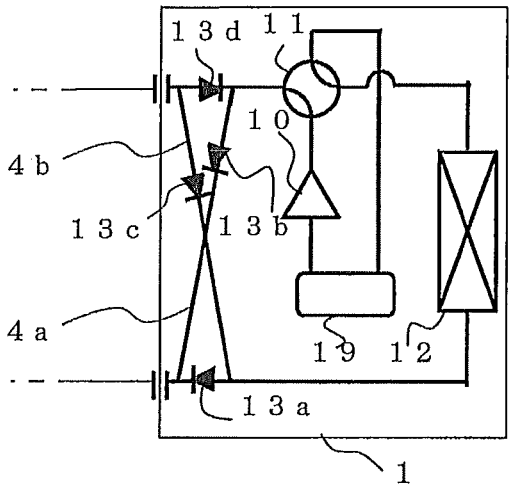
FIG. 2 is a drawing illustrating the constitution of the outdoor unit 1 according to the present embodiment.

FIG. 2 is a drawing illustrating the constitution of the outdoor unit 1 according to the present embodiment. The outdoor unit 1 has a compressor 10, a first refrigerant flow path switching device 11 such as a four-way switching valve, a heat source side heat exchanger 12 and an accumulator 19 and constitutes a part of the refrigerant circuit. The outdoor unit 1 also has check valve 13*a*, a check valve 13*b*, a check valve 13*c* and a check valve 13*d*. The flow of the heat source side refrigerant which flows in and flows out of the heat medium relay unit 3 should be constant regardless of the operation mode.

The compressor 10 sucks the heat source side refrigerant and compresses the heat source side refrigerant to a high temperature and a high pressure state and can be, for example, constituted with a capacity controllable inverter compressor. The first refrigerant flow path switching device 11 exchanges the flow of the heat source side refrigerant in heating operation (in heating only operation mode and heating main operation mode) and the flow of the heat source side refrigerant in cooling operation (in cooling only operation mode and cooling main operation mode). The heat source side heat exchanger 12 functions as an evaporator at the time of the heating operation and functions as a condenser (or a radiator) at the time of the cooling operation and performs heat exchange between air supplied by an air-sending device such as a fan not illustrated and a heat source side refrigerant, and makes the heat source side refrigerant to be evaporated and gasified or condensed and liquefied. An accumulator 19 is provided at the suction side of the compressor 10 and accumulates an excessive heat source side refrigerant.

The check valve 13*d* is provided at the refrigerant piping 4 between the heat medium relay unit 3 and the first refrigerant flow path switching device 11, and allows the flow of the heat source side refrigerant only in a predetermined direction (direction from the heat medium relay unit 3 to the outdoor unit 1). The check valve 13*a* is provided at the refrigerant piping 4 between the heat source side heat exchanger 12 and the heat medium relay unit 3 and allows the flow of the heat source side refrigerant only in a predetermined direction (direction from the outdoor unit 1 to the heat medium relay unit 3). The check valve 13*b* is provided at the first connection piping 4*a* and distributes the heat source side refrigerant discharged from the compressor 10 to the heat medium relay unit 3 at the time of heating operation. The check valve 13*c* is provided at the second connection piping 4*b* and distributes the heat source side refrigerant which returns from the heat medium relay unit 3 to the suction side of compressor 10 at the time of heating operation. Here, it does not need to provide the check valves 13 when it is not necessary to make the flow of the refrigerant constant.

[Indoor Unit 2]

The indoor unit 2 has a use side heat exchanger 26 respectively as shown in FIG. 1. This use side heat exchanger 26 is to connect to the heat medium flow control device 25 and the second heat medium flow path switching device 23 in the flow path switching unit 6 by piping 5. This use side heat exchanger 26 performs heat exchange between air supplied by the air-sending device (not illustrated) such as a fan, for example, air of the air-conditioning target space and the heat medium, and generates air for heating or air for cooling to be supplied indoor space. Here, in the present embodiment, remote controller (remote controller) 141 with which the operator gives instructions is, for example, assumed to be connected to indoor unit 2 as described later.

[Heat Medium Relay Unit 3]

Figure 3:
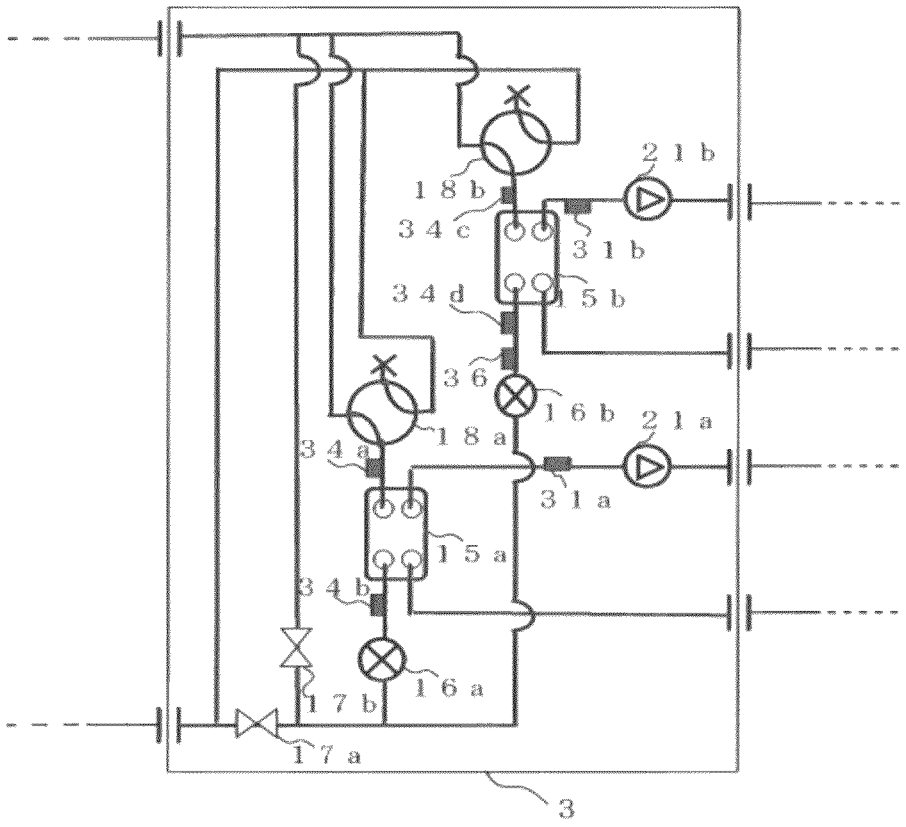
FIG. 3 is a drawing illustrating the constitution of the heat medium relay unit 3 according to the present embodiment.

FIG. 3 is a drawing illustrating the constitution of the heat medium relay unit 3 according to the present embodiment. Each heat medium relay unit 3 has two heat exchangers 15 related to heat medium, two expansion devices 16, two opening/closing devices 17, two second refrigerant flow path switching devices 18 and two pumps 21.

The two heat exchangers 15 (heat exchanger 15*a* related to heat medium and heat exchanger 15*b* related to heat medium) related to heat medium function as condensers (radiators) or evaporators, respectively. Heat exchange between the heat source side refrigerant and the heat medium transmits the cooling energy or heating energy which the outdoor unit 1 has saved in the heat source side refrigerant to heat medium. The heat exchanger 15*a* related to heat medium is provided between the expansion device 16*a* in the refrigerant circuit and the second refrigerant flow path switching device 18*a* and serves for the heating of the heat medium at the time of cooling and heating mixed operation mode as described later. In addition, the heat exchanger 15*b* related to heat medium is provided between the expansion device 16*b* and the second refrigerant flow path switching device 18*b* in the refrigerant circuit and serves for the cooling of the heat medium at the time of cooling and heating mixed operation mode.

The two expansion devices 16 (expansion device 16*a*, expansion device 16*b*) have a function as a pressure reducing valve and an expansion valve and decompress and inflate the heat source side refrigerant. The expansion device 16*a* is provided in the upstream side of the heat exchanger 15*a* related to heat medium in the flow of the heat source side refrigerant at the time of the cooling operation. The expansion device 16*b* is provided in the upstream side of the heat exchanger 15*b* related to heat medium in the flow of the heat source side refrigerant at the time of the cooling operation. The two expansion devices 16 can be constituted of, for example, electronic expansion valves variable and controllable in the opening degree.

The two opening/closing devices 17 (opening/closing device 17*a*, opening/closing device 17*b*) can be constituted of, for example, two-way valves, and they control the flow of the heat source side refrigerant in the refrigerant piping 4 by opening and closing. The opening/closing device 17*a* is provided at the refrigerant piping 4 on the inlet side of the heat source side refrigerant. The opening/closing device 17*b* is provided at the piping which connects the inlet side of the heat source side refrigerant and the refrigerant piping 4 on the outlet side. The two second refrigerant flow path switching devices 18 (second refrigerant flow path switching device 18*a*, second refrigerant flow path switching device 18*b*) consist of four-way switching valves or the like and they switch the flow of the heat source side refrigerant depending on the operation mode. The second refrigerant flow path switching device 18*a* is provided in the down stream side of heat exchanger 15*a* related to heat medium in the flow of the heat source side refrigerant at the time of the cooling operation. The second refrigerant flow path switching device 18*b* is provided in the down stream side of heat exchanger 15*b* related to heat medium in the flow of the heat source side refrigerant at the time of cooling only operation.

Two pumps 21 (pump 21*a*, pump 21*b*) circulate the heat medium which flows through the piping 5. The pump 21*a* is provided at the piping 5 between the heat exchanger 15*a* related to heat medium and the second heat medium flow path switching device 23. The pump 21*b* is provided at the piping 5 between the heat exchanger 15*b* related to heat medium and the second heat medium flow path switching device 23. For example, the two pumps 21 can be constituted with capacity controllable pumps.

[Flow Path Switching Unit 6]

Figure 4:
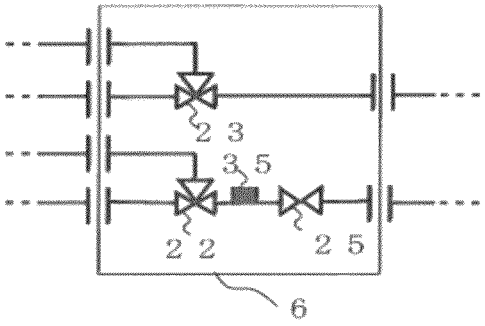
FIG. 4 is a drawing illustrating the constitution of the flow path switching unit 6 according to the present embodiment.

FIG. 4 is a drawing illustrating the constitution of the flow path switching unit 6 according to the present embodiment. Each flow path switching unit 6 controls presence/absence or amount of supply of a heat medium relating to heating or a heat medium relating to cooling which performs heat exchange with the air in the corresponding indoor unit 2. For this purpose, the first heat medium flow path switching device 22, the second heat medium flow path switching device 23 and the heat medium flow control device 25 are equipped. Here, the flow path switching unit 6 is constituted independently, but it may be incorporated in the heat medium relay unit 3 depending on cases.

The first heat medium flow path switching device 22 consists of, for example, a three-way switching valve, and switches the flow path of the heat medium. The first heat medium flow path switching device 22 is provided in a number (eight in the present embodiment) depending on the setting number of the indoor units 2. In the first heat medium flow path switching device 22, one of the three ways is connected to the heat exchanger 15*a* related to heat medium, the one of the three ways is connected to the heat exchanger 15*b* related to heat medium, and the other of three ways is connected to the heat medium flow control device 25, respectively, and it is provided at the outlet side of the heat medium flow path of the use side heat exchanger 26.

The second heat medium flow path switching device 23 consists of, for example, a three-way switching valve, and switches the flow path of the heat medium. The second heat medium flow path switching device 23 is provided in a number (eight herein) depending on the setting number of the indoor units 2. As for the second heat medium flow path switching device 23, one of the three ways is connected to the heat exchanger 15*a* related to heat medium, one of the three ways is connected to the heat exchanger 15*b* related to heat medium, and the other of three ways is connected to the use side heat exchanger 26, respectively, and it is provided at the inlet side of the heat medium flow path of the use side heat exchanger 26.

The heat medium flow control device 25 consists of two-way valves which can control opening area and controls flow volume to be passed through the piping 5. The heat medium flow control device 25 is provided in a number (eight herein) depending on the setting number of the indoor units 2. As for the heat medium flow control device 25, one way is connected to the use side heat exchanger 26, and the other way is connected to the first heat medium flow path switching device 22 respectively, and it is provided in the outlet side of the heat medium flow path of the use side heat exchanger 26. Here, the heat medium flow control device 25 may be provided at the inlet side of the heat medium flow path of the use side heat exchanger 26.

In addition, the heat medium relay unit 3 has various sensing devices (two first temperature sensors 31, four second temperature sensors 34 and a pressure sensor 36). Besides, the third temperature sensor 35 is provided at each flow path switching unit 6. These sensing devices detect physical amount such as temperature, pressure and so on and transmits detected signals to each controller mentioned later (there is a case wherein the controller which has received a signal transmits the signal to another controller). The physical amount to be detected will be used, as data, for the control of, for example, driving frequency of the compressor 10, the number of revolutions of the air-sending device (not illustrated), switching of the first refrigerant flow path switching device 11, operation frequency of the pump 21, switching of the second refrigerant flow path switching device 18, and switching of the flow path of the heat medium.

The two first temperature sensors 31 (first temperature sensor 31*a*, first temperature sensor 31*b*) detect the temperature (temperature of the heat medium at the outlet of the heat exchanger 15 related to heat medium) of the heat medium which has flowed out of the heat exchanger 15 related to heat medium in the heat medium relay unit 3 and, for example, can be constituted with thermistors. The first temperature sensor 31*a* is provided at the piping 5 on the inlet side of the pump 21*a*. The first temperature sensor 31*b* is provided at the piping 5 on the inlet side of the pump 21*b*.

Four second temperature sensors 34 (second temperature sensor 34*a* to second temperature sensor 34*d*) are provided on the inlet side or outlet side of the heat source side refrigerant of the heat exchanger 15 related to heat medium in the heat medium relay unit 3. They detect the temperature of the heat source side refrigerant flowing into the heat exchanger 15 related to heat medium or the temperature of the heat source side refrigerant which has flowed out of the heat exchanger 15 related to heat medium and can be constituted with thermistors. The second temperature sensor 34*a* is provided between the heat exchanger 15*a* related to heat medium and the second refrigerant flow path switching device 18*a*. The second temperature sensor 34*b* is provided between the heat exchanger 15*a* related to heat medium and the expansion device 16*a*. The second temperature sensor 34*c* is provided between the heat exchanger 15*b* related to heat medium and the second refrigerant flow path switching device 18*b*. The second temperature sensor 34*d* is provided between the heat exchanger 15*b* related to heat medium and the expansion device 16*b*.

The pressure sensor 36 is provided between the heat exchanger 15*b* related to heat medium and the expansion device 16*b* like the setting position of the second temperature sensor 34*d* in the heat medium relay unit 3, and detects the pressure of the heat source side refrigerant flowing between the heat exchanger 15*b* related to heat medium and the expansion device 16*b*.

In each flow path switching unit 6, the third temperature sensor 35 is provided between the first heat medium flow path switching device 22 and the heat medium flow control device 25, and detects the temperature of the heat medium which has flowed out of the use side heat exchanger 26 and can be constituted with thermistors. The third temperature sensors 35 are provided in a number (eight, herein) depending on the setting number of indoor units 2.

As above, the air-conditioning apparatus of the present embodiment combines the outdoor unit 1, the indoor unit 2, the heat medium relay unit 3, the refrigerant piping 4, the piping 5 and the flow path switching unit 6 to constitute a refrigerant circuit and a heat medium circulation circuit. When focusing on the circuit, the refrigerating cycle system constituting a refrigerant circuit is formed of the compressor 10, the first refrigerant flow path switching device 11, the heat source side heat exchanger 12, opening/closing device 17, the second refrigerant flow path switching device 18, the heat exchanger 15 (flow path of the heat source side refrigerant) related to heat medium, the expansion device 16 and the accumulator 19 which are connected with the refrigerant piping 4. In addition, a heat medium side system constituting the heat medium circulation circuit is formed of the heat exchanger 15 (flow path of the heat medium) related to heat medium, the pump 21, the first heat medium flow path switching device 22, the heat medium flow control device 25, the use side heat exchanger 26 and the second heat medium flow path switching device 23 with connecting by the piping 5.

Here in FIG. 1, check valves 41, 42, 43, 44 are provided at the outlets of pumps 21 of the heat medium relay units 3 for allowing the heat medium to flow only in the outflow direction (for preventing reverse flow) with pumps 21 in the heat medium circulation circuit. These check valves may be disposed within the heat medium relay units 3 and may be deletable if there is a similar reverse flow prevention function in the pumps 21.

Next described are respective operation modes in the air-conditioning apparatus of the present embodiment along with the flows of the heat source side refrigerant and the heat medium. In this air-conditioning apparatus, cooling operation or heating operation can be voluntarily selected in each indoor unit 2 based on the instructions from each indoor unit 2. On this account, there are cases when all the indoor units 2 involved in the operation perform heating operation, when all the indoor units 2 involved in the operation perform cooling operation, and when a part of the indoor units 2 involved in the operation perform cooling operation and the rest of the indoor units 2 perform heating operation.

On this account, the air-conditioning apparatus of the present embodiment can be operated in cooling only operation mode, heating only operation mode and cooling and heating mixed operation mode. The cooling and heating mixed operation mode can be further divided into cooling main operation, an operation mode in which cooling capacity is mainly exerted and heating main operation, an operation mode in which heating capacity is mainly exerted. Here, the circulation paths of the heat source side refrigerant are different in respective modes in the refrigerant circuit. For example, when all the running indoor units 2 perform cooling, it is basically an operation in cooling only operation. In the meantime, when all the running indoor units 2 perform heating, it is basically an operation in heating only operation. Here, in the description relating to the operation mode, it is assumed that the air-conditioning shall perform with a single line of the refrigerant circuit and the heat medium circulation circuit for the sake of simplifying the description. In addition, as for the indoor units 2 and the flow path switching unit 6, indoor units 2-A to 2-D, and flow path switching units 6-A to 6-D are illustrated.

[Cooling Only Operation Mode]

Figure 5:
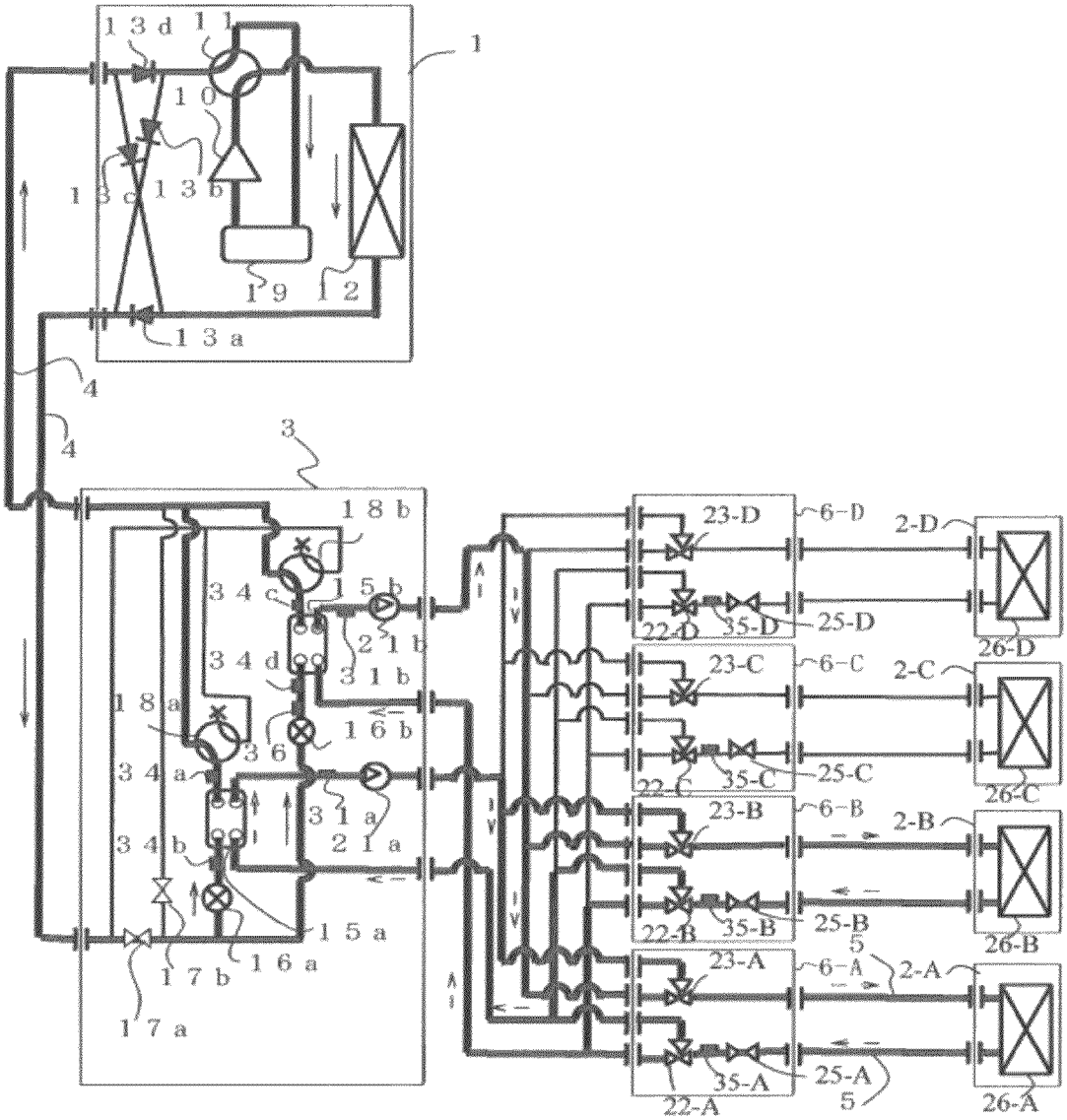
FIG. 5 is a drawing illustrating the flow of the refrigerant in cooling only operation mode.

FIG. 5 is a drawing illustrating the flow of the refrigerant in cooling only operation. In this FIG. 5, cooling only operation is described exemplifying a case wherein cooling load is generated only in the use side heat exchanger 26-A and the use side heat exchanger 26-B. Here in FIG. 5, the piping represented in bold lines shows the piping through which the refrigerant (heat source side refrigerant and heat medium) flows. In FIG. 5, the flow direction of the heat medium is shown with dashed line arrows and the flow direction of the heat source side refrigerant is shown with solid line arrows.

In the case of the air-conditioning apparatus shown in FIG. 5 being in cooling only operation, the outdoor unit 1 switches the first refrigerant flow path switching device 11 so that the heat source side refrigerant discharged from the compressor 10 may flow into the heat source side heat exchanger 12. The heat medium relay units 3 drive pumps 21*a* and pump 21*b* to open the heat medium flow control device 25-A and the heat medium flow control device 25-B and completely close the heat medium flow control device 25-C and the heat medium flow control device 25-D, and thus circulate heat medium between each of the heat exchanger 15*a* related to heat medium and the heat exchanger 15*b* related to heat medium and the use side heat exchanger 26-A and the use side heat exchanger 26-B.

At first, the flow of the heat source side refrigerant in the refrigerant circuit is described. The heat source side refrigerant at a low temperature and a low pressure is compressed by the compressor 10, and it is discharged as a gas refrigerant at a high temperature and a high pressure. The high temperature and high pressure gas refrigerant discharged from the compressor 10 flows into the heat source side heat exchanger 12 through the first refrigerant flow path switching device 11. And it is liquefied and condensed while transferring the heat to the outdoor air at the heat source side heat exchanger 12, and it becomes a high pressure liquid refrigerant. The high pressure liquid refrigerant which has flowed out of the heat source side heat exchanger 12 passes through the check valve 13*a* to flow out of the outdoor unit 1 and passes through the refrigerant piping 4 to flow into the heat medium relay unit 3. The high pressure liquid refrigerant which has flowed into the heat medium relay unit 3 is, after having passed via the opening/closing device 17*a*, is branched and inflated in the expansion device 16*a* and the expansion device 16*b*, and it becomes a two-phase refrigerant at a low temperature and a low pressure.

This two-phase refrigerant flows into each of the heat exchanger 15*a* related to heat medium and the heat exchanger 15*b* related to heat medium which act as evaporators and while receiving heat from the heat medium circulating through the heat medium circulation circuit, it cools the heat medium while it becomes a gas refrigerant at a low temperature and a low pressure. The gas refrigerant which has flowed out of the heat exchanger 15*a* related to heat medium and the heat exchanger 15*b* related to heat medium flows out of the heat medium relay unit 3 through the second refrigerant flow path switching device 18*a* and the second refrigerant flow path switching device 18*b* and passes through the refrigerant piping 4 to flow into the outdoor unit 1 again. The heat source side refrigerant which has flowed into the outdoor unit 1 passes through the check valve 13*d*, and, through the first refrigerant flow path switching device 11 and accumulator 19, it is sucked into the compressor 10 again.

As for the expansion device 16*a* at that time, the opening degree thereof is controlled so that superheat obtained as a difference between the temperature detected at the second temperature sensor 34*a* and the temperature detected at the second temperature sensor 34*b* may be constant. As for the expansion device 16*b*, the opening degree is controlled likewise so that superheat provided as a difference in temperature detected at the second temperature sensor 34*c* and the temperature detected at the second temperature sensor 34*d* may become constant. The opening/closing device 17*a* is open and the opening/closing device 17*b* is closed.

Next, the flow of the heat medium in the heat medium circulation circuit is described. In cooling only operation mode, the cooling energy of the heat source side refrigerant in both sides of the heat exchanger 15*a* related to heat medium and the heat exchanger 15*b* related to heat medium is transferred to the heat medium and the cooled heat medium will be passed through in the piping 5 by the pump 21*a* and the pump 21*b*. The heat medium which is pressurized at the pump 21*a* and the pump 21*b* and flowed out passes through the second heat medium flow path switching device 23-A and the second heat medium flow path switching device 23-B to flow into the use side heat exchanger 26-A and the use side heat exchanger 26-B. And the heat medium receives heat from the indoor air at the use side heat exchanger 26-A and the use side heat exchanger 26-B and thereby cools the indoor space.

Then, the heat medium flows out of the use side heat exchanger 26-A and the use side heat exchanger 26-B to flow into the heat medium flow control device 25-A and the heat medium flow control device 25-B. The flow volume is controlled at this time by the action of the heat medium flow control device 25-A and the heat medium flow control device 25-B to be a flow volume necessary for covering the air-conditioning load needed indoors and comes to flow into the use side heat exchanger 26-A and the use side heat exchanger 26-B. The heat medium which has flowed from the heat medium flow control device 25-A and the heat medium flow control device 25-B passes through the first heat medium flow path switching device 22-A and the first heat medium flow path switching device 22-B to flow into the heat exchanger 15*a* related to heat medium and the heat exchanger 15*b* related to heat medium and, it is sucked again into the pump 21*a* and the pump 21*b*.

Here in the piping 5 of the use side heat exchanger 26, the heat medium flows in the direction from the second heat medium flow path switching device 23 to the first heat medium flow path switching device 22 via the heat medium flow control device 25. In addition, the air-conditioning load needed in indoor space can be covered by controlling the difference between the temperature detected at the first temperature sensor 31*a* or the temperature detected at the first temperature sensor 31*b* and the third temperature sensor 35 within a targeted value. The outlet temperature of the heat exchanger 15 related to heat medium may be either the temperature of the first temperature sensor 31*a* or the first temperature sensor 31*b* and the average of these temperatures may be used. The first heat medium flow path switching device 22 and the second heat medium flow path switching device 23 have a medium opening degree at this time so that the flow path flowing to the both sides of the heat exchanger 15*a* related to heat medium and the heat exchanger 15*b* related to heat medium can be secured.

When cooling only operation is carried out, there is no need to flow the heat medium into the use side heat exchanger 26 (including a thermo-off) which does not have a thermal load, and therefore, the flow path should be closed by the heat medium flow control device 25 so that no heat medium may flow to the use side heat exchanger 26. In FIG. 5, heat medium is flowed in the use side heat exchanger 26-A and the use side heat exchanger 26-B since there is thermal load therein, but there is no heat load in the use side heat exchanger 26-C and the use side heat exchanger 26-D, and therefore, the heat medium flow control device 25-C and the heat medium flow control device 25-D are fully closed. And when there is occurrence of thermal load from the use side heat exchanger 26-C and/or the use side heat exchanger 26-D, the heat medium may be circulated by opening the heat medium control device 25-C and/or the heat medium flow control device 25-D.

[Heating Only Operation Mode]

Figure 6:
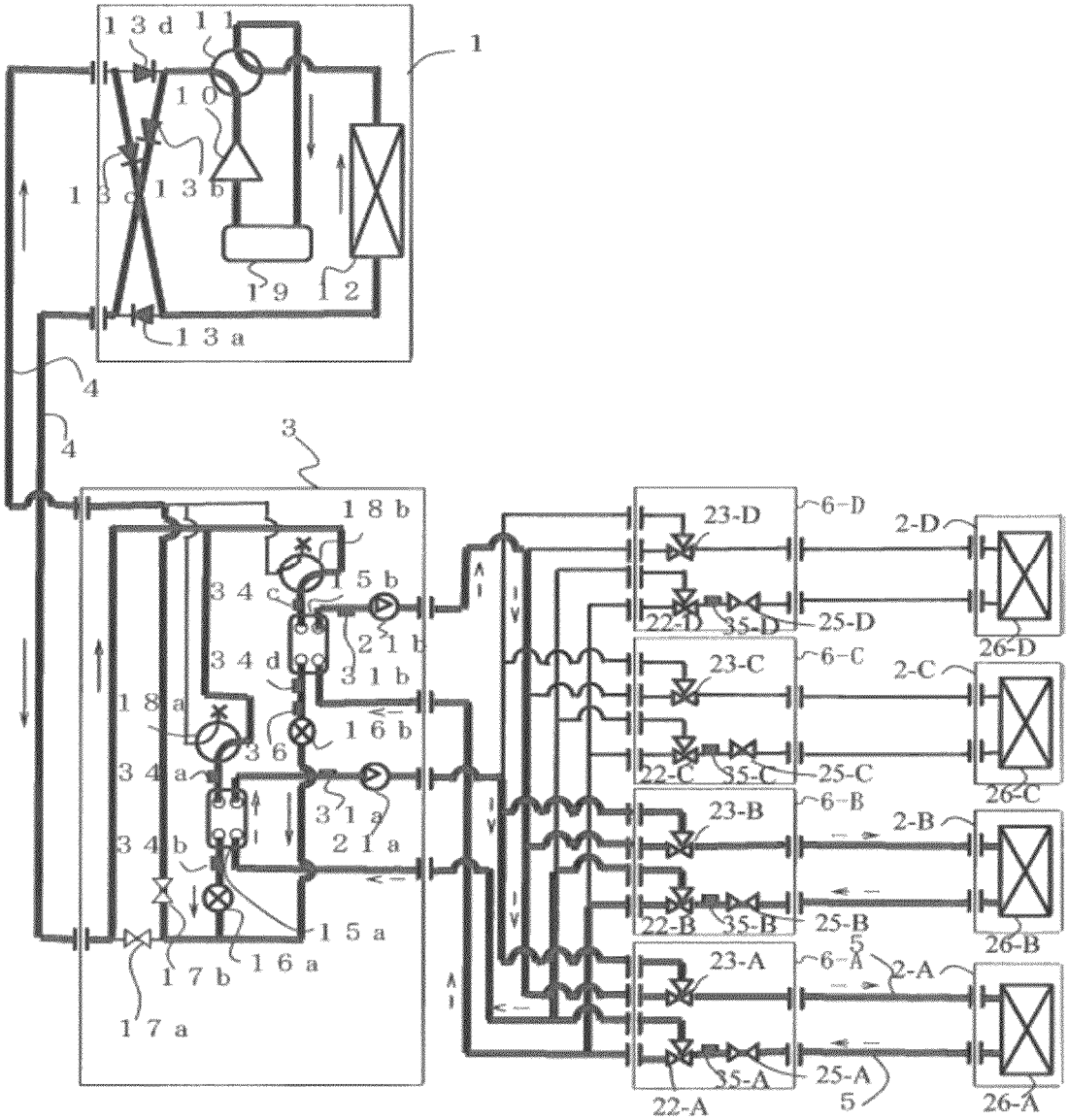
FIG. 6 is a drawing illustrating the flow of the refrigerant in heating only operation mode.

FIG. 6 is a drawing illustrating the flow of the refrigerant in heating only operation mode. In this FIG. 6, heating only operation is described as an example for the case wherein heating load occurs only in the use side heat exchanger 26-A and the use side heat exchanger 26-B. Here in FIG. 6, the piping represented in bold line shows the piping through which the refrigerant (heat source side refrigerant and heat medium) flows. In addition, in FIG. 6, the flow direction of the heat medium is shown with dashed line arrows and the flow direction of the heat source side refrigerant is shown with solid line arrows.

In the case of heating only operation mode shown in FIG. 6, the outdoor unit 1 switches the first refrigerant flow path switching device 11 so that the heat source side refrigerant discharged from the compressor 10 may flow into the heat medium relay unit 3 without passing via the heat source side heat exchanger 12. The heat medium relay unit 3 drives the pump 21*a* and the pump 21*b* and opens the heat medium flow control device 25-A and the heat medium flow control device 25-B and fully closes the heat medium flow control device 25-C and the heat medium flow control device 25-D so that the heat medium may circulate between each of the heat exchanger 15*a* related to heat medium and the heat exchanger 15*b* related to heat medium and the use side heat exchanger 26-A and the use side heat exchanger 26-B.

At first is described the flow of the heat source side refrigerant in the refrigerant circuit. A heat source side refrigerant at a low temperature and a low pressure is compressed by the compressor 10, and it is discharged as a gas refrigerant at a high temperature and a high pressure. The high temperature and high pressure gas refrigerant discharged from the compressor 10 passes through the first refrigerant flow path switching device 11 and passes the check valve 13*b* and flows out from the outdoor unit 1. The high temperature and high pressure gas refrigerant which has flowed out of the outdoor unit 1 passes through the refrigerant piping 4 to flow into the heat medium relay unit 3. The gas refrigerant at a high temperature and a high pressure which has flowed into the heat medium relay unit 3 is branched and passes through the second refrigerant flow path switching device 18*a* and the second refrigerant flow path switching device 18*b* to flow into each of the heat exchanger 15*a* related to heat medium and the heat exchanger 15*b* related to heat medium.

The gas refrigerant at a high temperature and a high pressure which has flowed into the heat exchanger 15*a* related to heat medium and the heat exchanger 15*b* related to heat medium is liquefied and condensed while transferring heat to the heat medium circulating through a heat medium circulation circuit to be a high pressure liquid refrigerant. The liquid refrigerant which has flowed out of the heat exchanger 15*a* related to heat medium and the heat exchanger 15*b* related to heat medium is inflated in the expansion device 16*a* and the expansion device 16*b*, and it becomes a two-phase refrigerant at a low temperature and a low pressure. This two-phase refrigerant passes through the opening/closing device 17*b* and flows out of the heat medium relay unit 3 and passes through the refrigerant piping 4 to flow into the outdoor unit 1 again. The heat source side refrigerant which has flowed into the outdoor unit 1 passes the check valve 13*c* to flow into the heat source side heat exchanger 12 which acts as an evaporator.

And the heat source side refrigerant which has flowed into the heat source side heat exchanger 12 receives heat from outdoor air at the heat source side heat exchanger 12, and it becomes a gas refrigerant at a low temperature and a low pressure. The gas refrigerant at a low temperature and a low pressure which has flowed out from the heat source side heat exchanger 12 is sucked into the compressor 10 through the first refrigerant flow path switching device 11 and the accumulator 19 again.

As for the expansion device 16*a*, the opening degree thereof is controlled at this time so that subcool obtained as a difference between the value converted as a saturation temperature from the pressure detected at the pressure sensor 36 and the temperature detected at the second temperature sensor 34*b* may be constant. As for the expansion device 16*b*, the opening degree thereof is controlled likewise so that subcool obtained as a difference between the value which the pressure detected at the pressure sensor 36 is converted as a saturation temperature and the temperature detected at the second temperature sensor 34*d* may be constant. Here, the opening/closing device 17*a* is shut, and opening/closing device 17*b* is open. In addition, when the temperature at the intermediate position of the heat exchanger 15 related to heat medium can be measured, the temperature at the intermediate position may be used in substitution for pressure sensor 36 and thereby an inexpensive system can be constructed.

Next is described the flow of the heat medium in the heat medium circulation circuit. In heating only operation mode, the heating energy of the heat source side refrigerant is transferred to the heat medium in both sides of the heat exchanger 15*a* related to heat medium and the heat exchanger 15*b* related to heat medium, and the warmed heat medium will be passed through the piping 5 by the pump 21*a* and the pump 21*b*. The heat medium which is pressurized in the pump 21*a* and the pump 21*b* and has been flowed out flows into the use side heat exchanger 26-A and the use side heat exchanger 26-B through the second heat medium flow path switching device 23-A and the second heat medium flow path switching device 23-B. And heating of the indoor space is performed by the heat medium which transfers heat to the indoor air in the use side heat exchanger 26-A and the use side heat exchanger 26-B.

Then the heat medium flows out of the use side heat exchanger 26-A and the use side heat exchanger 26-B to flow into the heat medium flow control device 25-A and the heat medium flow control device 25-B. At this time, the flow volume of the heat medium is controlled to the flow volume necessary for covering the air-conditioning load needed indoors by the action of the heat medium flow control device 25-A and the heat medium flow control device 25-B and flows into the use side heat exchanger 26-A and the use side heat exchanger 26-B. The heat medium which has flowed out from the heat medium flow control device 25-A and the heat medium flow control device 25-B passes through the first heat medium flow path switching device 22-A and the first heat medium flow path switching device 22-B flows into the heat exchanger 15*a* related to heat medium and the heat exchanger 15*b* related to heat medium and it is sucked into the pump 21*a* and the pump 21*b* again.

In addition, in the piping 5 of the use side heat exchanger 26, the heat medium flows in the direction from the second heat medium flow path switching device 23 to the first heat medium flow path switching device 22 via the heat medium flow control device 25. Here, the air-conditioning load needed in indoor space can be covered by controlling the difference between the temperature detected at the first temperature sensor 31*a* or the temperature detected at the first temperature sensor 31*b* and the third temperature sensor 35 within a targeted value. The outlet temperature of the heat exchanger 15 related to heat medium may be either the temperature of the first temperature sensor 31*a* or the first temperature sensor 31*b* and the average of these temperatures may be used.

The first heat medium flow path switching device 22 and the second heat medium flow path switching device 23 have a medium opening degree at this time so that the flow path flowing to the both sides of the heat exchanger 15*a* related to heat medium and the heat exchanger 15*b* related to heat medium can be secured. In addition, the use side heat exchanger 26-A should be originally controlled by the temperature difference between the inlet and the outlet, but the temperature of the heat medium at the inlet side of the use side heat exchanger 26 is almost the same as the temperature detected by the first temperature sensor 31*b* and the number of temperature sensors can be reduced by using the first temperature sensor 31*b* and thereby an inexpensive system can be constructed.

When heating only operation mode is carried out, there is no need to flow the heat medium into the use side heat exchanger 26 (including a thermo-off) which does not have a thermal load, and therefore, the flow path should be closed by the heat medium flow control device 25 so that no heat medium may flow to the use side heat exchanger 26. In FIG. 6, heat medium is flowed in the use side heat exchanger 26-A and the use side heat exchanger 26-B since there is thermal load therein, but there is no thermal load in the use side heat exchanger 26-C and the use side heat exchanger 26-D, and therefore, the heat medium flow control device 25-C and the heat medium flow control device 25-D are fully closed.

And when there is occurrence of thermal load from the use side heat exchanger 26-C and/or the use side heat exchanger 26-D, the heat medium may be circulated by opening the heat medium control device 25-C and/or the heat medium flow control device 25-D.

[Cooling Main Operation]

Figure 7:
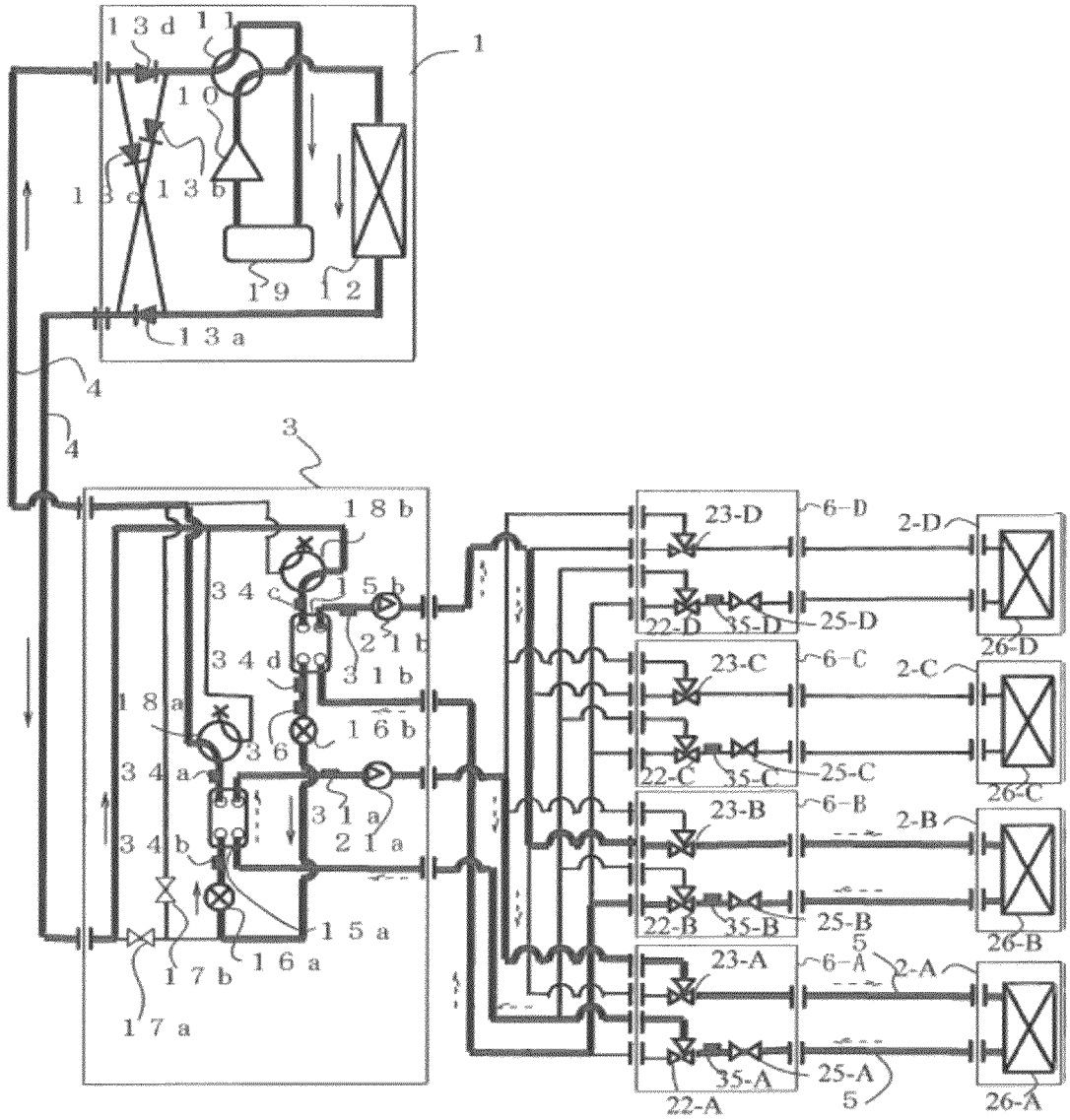
FIG. 7 is a drawing illustrating the flow of the refrigerant in cooling main operation mode.

FIG. 7 is a drawing illustrating the flow of the refrigerant in cooling main operation. In this FIG. 7, cooling main operation is described as an example for the case wherein cooling load occurs in the use side heat exchanger 26-A, and heating load occurs in the use side heat exchanger 26-B. Here in FIG. 7, the piping represented in bold line shows the piping through which the refrigerant (heat source side refrigerant and heat medium) circulates. In addition, in FIG. 7, the flow direction of the heat medium is shown with dashed line arrows and the flow direction of the heat source side refrigerant is shown with solid line arrows.

In the case of cooling main operation mode shown in FIG. 7, the outdoor unit 1 switches the first refrigerant flow path switching device 11 so that the heat source side refrigerant discharged from the compressor 10 may flow into the heat source side heat exchanger 12. The heat medium relay unit 3 drives the pump 21*a* and the pump 21*b* and opens the heat medium flow control device 25-A and the heat medium flow control device 25-B and fully closes the heat medium flow control device 25-C and the heat medium flow control device 25-D so that the heat medium may circulate between the heat exchanger 15*a* related to heat medium and the use side heat exchanger 26-A, and between the heat exchanger 15*b* related to heat medium and the use side heat exchanger 26-B, respectively.

At first is described the flow of the heat source side refrigerant in the refrigerant circuit. A heat source side refrigerant at a low temperature and a low pressure is compressed by the compressor 10, and it is discharged as a gas refrigerant at a high temperature and a high pressure. The high temperature and high pressure gas refrigerant discharged from the compressor 10 passes through the first refrigerant flow path switching device 11 and flows into the heat source side heat exchanger 12. And it is liquefied and condensed while transferring heat to the outdoor air in the heat source side heat exchanger 12, and it becomes a two-phase refrigerant. The two-phase refrigerant which has flowed out of the heat source side heat exchanger 12 passes through the check valve 13*a* and flows out of the outdoor unit 1 and passes through the refrigerant piping 4 to flow into the heat medium relay unit 3. The two-phase refrigerant which has flowed into the heat medium relay unit 3 passes through the second refrigerant flow path switching device 18*b* and flows into the heat exchanger 15*b* related to heat medium, which acts as a condenser.

The two-phase refrigerant which has flowed into the heat exchanger 15*b* related to heat medium is liquefied and condensed while transferring the heat to the heat medium circulating through a heat medium circulation circuit, and it becomes a liquid refrigerant. The liquid refrigerant which has flowed out of the heat exchanger 15*b* related to heat medium is inflated in the expansion device 16*b*, and it becomes a low pressure two-phase refrigerant. This low pressure two-phase refrigerant flows into the heat exchanger 15*a* related to heat medium which acts as an evaporator through the expansion device 16*a*. The low pressure two-phase refrigerant which has flowed into the heat exchanger 15*a* related to heat medium becomes a gas refrigerant at a low pressure while cooling the heat medium by receiving heat from a heat medium circulating through a heat medium circulation circuit. This gas refrigerant flows out of the heat exchanger 15*a* related to heat medium and flows out of the heat medium relay unit 3 through the second refrigerant flow path switching device 18*a* and passes through the refrigerant piping 4 to flow into the outdoor unit 1 again. The heat source side refrigerant which has flowed into the outdoor unit 1 passes through the check valve 13*d*, passes through the first refrigerant flow path switching device 11 and accumulator 19, and it is sucked into the compressor 10 again.

As for the expansion device 16*b* at this time, the opening degree thereof is controlled so that superheat obtained as a difference in temperature between the temperature detected at the second temperature sensor 34*a* and the temperature detected at the second temperature sensor 34*b* may become constant. Here, the expansion device 16*a* is fully open, the opening/closing device 17*a* is closed, and the opening/closing device 17*b* is closed. Here, as for the expansion device 16*b*, the opening degree thereof may be controlled so that subcool obtained as a difference between the value converted as a saturation temperature from the pressure detected at the pressure sensor 36 and the temperature detected at the second temperature sensor 34*d* may be constant. The expansion device 16*b* may be fully open and superheat or subcool may be controlled in the expansion device 16*a*.

Next is described the flow of the heat medium in the heat medium circulation circuit. In cooling main operation mode, the heating energy of the heat source side refrigerant is transferred to the heat medium in the heat exchanger 15*b* related to heat medium, and the warmed heat medium will be passed through the piping 5 by the pump 21*b*. In addition, the cooling energy of the heat source side refrigerant is transferred to the heat medium in the heat exchanger 15*a* related to heat medium in cooling main operation, and the cooled heat medium will be passed through by the pump 21*a* in the piping 5. The heat medium which is pressurized in the pump 21*a* and the pump 21*b* and has been flowed out flows into the use side heat exchanger 26-A and the use side heat exchanger 26-B through the second heat medium flow path switching device 23-A and the second heat medium flow path switching device 23-B.

Heating of the indoor space is performed by the heat medium which transfers heat to indoor air in the use side heat exchanger 26-B. In addition, cooling of the indoor space is performed by the heat medium which receives heat from the indoor air in the use side heat exchanger 26-A. At this time, the flow volume of the heat medium is controlled to the flow volume necessary for covering the air-conditioning load needed indoors by the action of the heat medium flow control device 25-A and the heat medium flow control device 25-B and flows into the use side heat exchanger 26-A and the use side heat exchanger 26-B. The heat medium which passes through the use side heat exchanger 26-B and whose temperature is somewhat lowered passes through the heat medium flow control device 25-B and the first heat medium flow path switching device 22-B, flows into the heat exchanger 15*b* related to heat medium and it is sucked into the pump 21*b* again. The heat medium which passes through the use side heat exchanger 26-A and whose temperature is somewhat elevated passes through the heat medium flow control device 25-A and the first heat medium flow path switching device 22-A, flows into the heat exchanger 15*a* related to heat medium and it is sucked into the pump 21*a* again.

During this process, the warm heat medium and the cold heat medium are introduced into the use side heat exchanger 26 having heating load and cooling load respectively without being mixed by the action of the first heat medium flow path switching device 22 and the second heat medium flow path switching device 23. Here, in the piping 5 of the use side heat exchanger 26, a heat medium flows from the second heat medium flow path switching device 23 via heat medium flow control device 25 to the first heat medium flow path switching device 22 in both the heating side and the cooling side directions. In addition, the air-conditioning load needed in indoor space can be covered by controlling the difference between the temperature detected at the first temperature sensor 31*b* and the third temperature sensor 35 within a targeted value on the heating side and by controlling the difference between the temperature detected at the first temperature sensor 31*a* and the third temperature sensor 35 within a targeted value on the cooling side.

When cooling main operation is carried out, there is no need to flow the heat medium into the use side heat exchanger 26 (including a thermo-off) which does not have a thermal load, and therefore, the flow path should be closed by the heat medium flow control device 25 so that no heat medium may flow to the use side heat exchanger 26. In FIG. 7, heat medium is flowed in the use side heat exchanger 26-A and the use side heat exchanger 26-B since there is thermal load therein, but there is no thermal load in the use side heat exchanger 26-C and the use side heat exchanger 26-D, and therefore, the heat medium flow control device 25-C and the heat medium flow control device 25-D are fully closed. And when there is occurrence of thermal load from the use side heat exchanger 26-C and/or the use side heat exchanger 26-D, the heat medium may be circulated by opening the heat medium control device 25-C and/or the heat medium flow control device 25-D.

[Heating Main Operation Mode]

Figure 8:
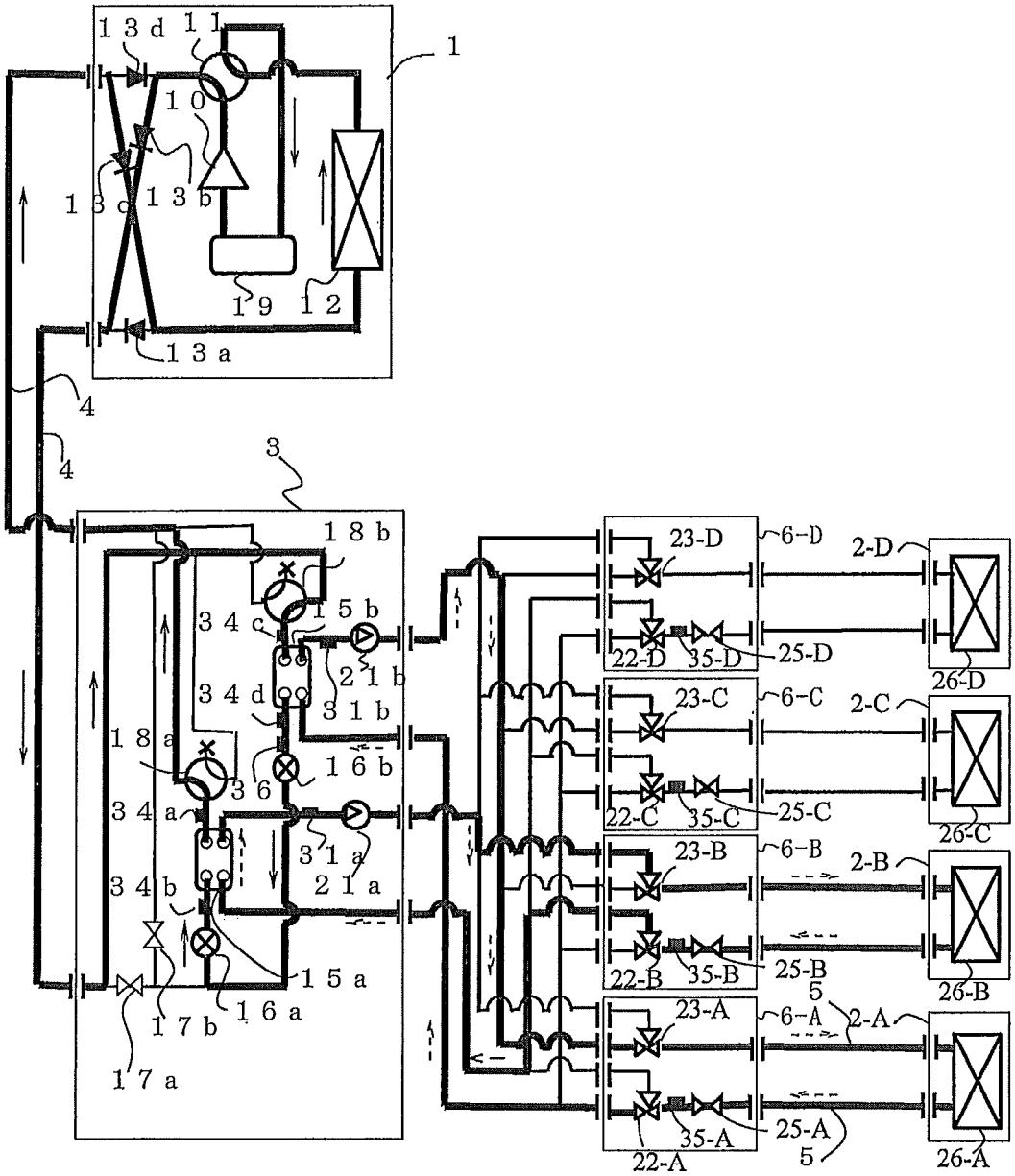
FIG. 8 is a drawing illustrating the flow of the refrigerant in the heating main operation mode.

FIG. 8 is a drawing illustrating the flow of the refrigerant in heating main operation mode. In this FIG. 8, heating main operation is described as an example for the case wherein heating load occurs in the use side heat exchanger 26-A and cooling load occurs in the use side heat exchanger 26-B. Here in FIG. 8, the piping represented in bold line shows the piping through which the refrigerant (heat source side refrigerant and heat medium) circulates. In addition, in FIG. 8, the flow direction of the heat medium is shown with dashed line arrows and the flow direction of the heat source side refrigerant is shown with solid line arrows.

In the case of heating main operation mode shown in FIG. 8, the outdoor unit 1 switches the first refrigerant flow path switching device 11 so that the heat source side refrigerant discharged from the compressor 10 may flow into the heat medium relay unit 3 without passing via the heat source side heat exchanger 12. The heat medium relay unit 3 drives the pump 21*a* and the pump 21*b* and opens the heat medium flow control device 25-A and the heat medium flow control device 25-B and fully closes the heat medium flow control device 25-C and the heat medium flow control device 25-D so that the heat medium may circulate between the heat exchanger 15*a* related to heat medium and the use side heat exchanger 26-B, and between the heat exchanger 15*b* related to heat medium and the use side heat exchanger 26-A, respectively.

At first is described the flow of the heat source side refrigerant in the refrigerant circuit. The refrigerant at a low temperature and a low pressure is compressed by the compressor 10, and it is discharged as a gas refrigerant at a high temperature and a high pressure. A high temperature and high pressure gas refrigerant discharged from the compressor 10 passes through the first refrigerant flow path switching device 11 and passes the check valve 13*b* and flows out from the outdoor unit 1. The high temperature and high pressure gas refrigerant which has flowed out of the outdoor unit 1 passes through the refrigerant piping 4 to flow into the heat medium relay unit 3. The gas refrigerant at a high temperature and a high pressure which has flowed into the heat medium relay unit 3 passes through the second refrigerant flow path switching device 18*b* to flow into the heat exchanger 15*b* related to heat medium which acts as a condenser.

The gas refrigerant which has flowed into the heat exchanger 15*b* related to heat medium is liquefied and condensed while transferring the heat to a heat medium circulating through a heat medium circulation circuit, and it becomes a liquid refrigerant. The liquid refrigerant which has flowed out of the heat exchanger 15*b* related to heat medium is inflated in the expansion device 16*b*, and it becomes a low pressure two-phase refrigerant. This low pressure two-phase refrigerant flows into the heat exchanger 15*a* related to heat medium which acts as an evaporator through the expansion device 16*a*. The low pressure two-phase refrigerant which has flowed into the heat exchanger 15*a* related to heat medium is evaporated while receiving heat from a heat medium circulating through a heat medium circulation circuit, and cools the heat medium. This low pressure two-phase refrigerant flows out of the heat exchanger 15*a* related to heat medium and flows out of the heat medium relay unit 3 via the second refrigerant flow path switching device 18*a* and passes through the refrigerant piping 4 to flow into the outdoor unit 1 again.

The heat source side refrigerant which has flowed into the outdoor unit 1 passes through the check valve 13*c* to flow into the heat source side heat exchanger 12 which acts as an evaporator. And the heat source side refrigerant which has flowed into the heat source side heat exchanger 12 receives heat from the outdoor air in the heat source side heat exchanger 12, and it becomes a gas refrigerant at a low temperature and a low pressure. The gas refrigerant at a low temperature and a low pressure which has flowed out from the heat source side heat exchanger 12 is sucked into the compressor 10 through the first refrigerant flow path switching device 11 and accumulator 19 again.

As for the expansion device 16*b*, the opening degree thereof is controlled at this time so that subcool obtained as a difference between the value converted as a saturation temperature from the pressure detected at the pressure sensor 36 and the temperature detected at the second temperature sensor 34*b* may be constant. Here, the expansion device 16*a* is fully open, the opening/closing device 17*a* is closed and the opening/closing device 17*b* is closed. The expansion device 16*b* may be fully open and it may be controlled with subcool in the expansion device 16*a*.

Next is described the flow of the heat medium in the heat medium circulation circuit. In heating main operation mode, the heating energy of the heat source side refrigerant is transferred to the heat medium in the heat exchanger 15*b* related to heat medium, and the warmed heat medium will be passed through the piping 5 by the pump 21*b*. In addition, in heating main operation mode, the cooling energy of the heat source side refrigerant is transferred to the heat medium in the heat exchanger 15*a* related to heat medium, and the cooled heat medium will be passed through the piping 5 by the pump 21*a*. The heat medium which is pressurized in the pump 21*a* and the pump 21*b* and has been flowed out flows into the use side heat exchanger 26-A and the use side heat exchanger 26-B through the second heat medium flow path switching device 23-A and the second heat medium flow path switching device 23-B, respectively.

Cooling of the indoor space is performed by the heat medium which receives heat from the indoor air in the use side heat exchanger 26-B. In addition, heating of the indoor space is performed by the heat medium which transfers heat to the indoor air in the use side heat exchanger 26-A. At this time, the flow volume of the heat medium is controlled to the flow volume necessary for covering the air-conditioning load needed indoors by the action of the heat medium flow control device 25-A and the heat medium flow control device 25-B and flows into the use side heat exchanger 26-A and the use side heat exchanger 26-B. The heat medium which passes through the use side heat exchanger 26-B and whose temperature is somewhat elevated passes through the heat medium flow control device 25-B and the first heat medium flow path switching device 22-B, flows into the heat exchanger 15*a* related to heat medium and it is sucked into the pump 21*a* again. The heat medium which passes through the use side heat exchanger 26-A and whose temperature is somewhat lowered passes through the heat medium flow control device 25-A and the first heat medium flow path switching device 22-A, flows into the heat exchanger 15*b* related to heat medium and it is sucked into the pump 21*b* again.

During this process, the warm heat medium and the cold heat medium are introduced into the use side heat exchanger 26 having heating load and cooling load respectively without being mixed by the action of the first heat medium flow path switching device 22 and the second heat medium flow path switching device 23. Here, in the piping 5 of the use side heat exchanger 26, a heat medium flows from the second heat medium flow path switching device 23 via heat medium flow control device 25 to the first heat medium flow path switching device 22 in both the heating side and the cooling side directions. In addition, the air-conditioning load needed in indoor space can be covered by controlling the difference between the temperature detected at the first temperature sensor 31*b* and the third temperature sensor 35 within a targeted value on the heating side and by controlling the difference between the temperature detected at the first temperature sensor 31*a* and the second temperature sensor 34 within a targeted value on the cooling side.

When heating main operation is carried out, there is no need to flow the heat medium into the use side heat exchanger 26 (including a thermo-off) which does not have a thermal load, and therefore, the flow path should be closed by the heat medium flow control device 25 so that no heat medium may flow to the use side heat exchanger 26. In FIG. 8, heat medium is flowed in the use side heat exchanger 26-A and the use side heat exchanger 26-B since there is thermal load therein, but there is no thermal load in the use side heat exchanger 26-C and the use side heat exchanger 26-D, and therefore, the heat medium flow control device 25-C and the heat medium flow control device 25-D are fully closed. And when there is occurrence of thermal load from the use side heat exchanger 26-C and/or the use side heat exchanger 26-D, the heat medium may be circulated by opening the heat medium control device 25-C and/or the heat medium flow control device 25-D.

Figure 9:
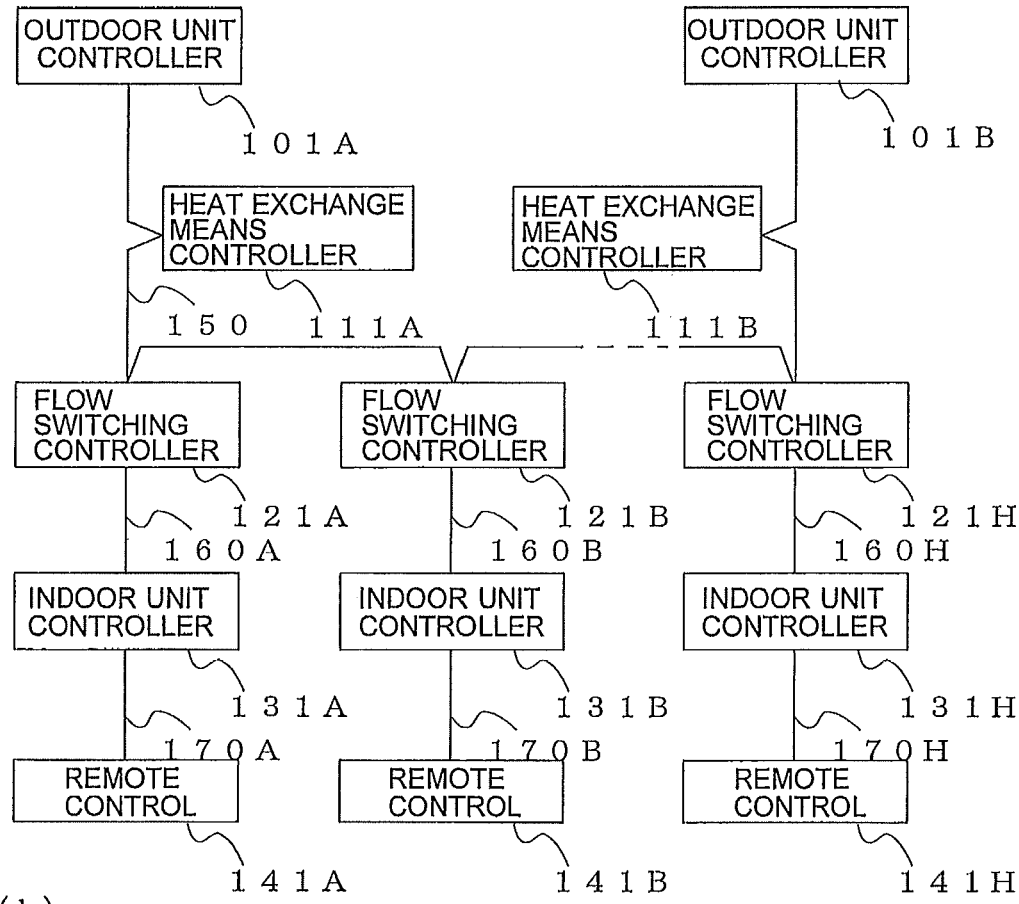
FIG. 9 is a drawing illustrating the communication connection relation of controllers and the like according to the present embodiment.
Figure 9:
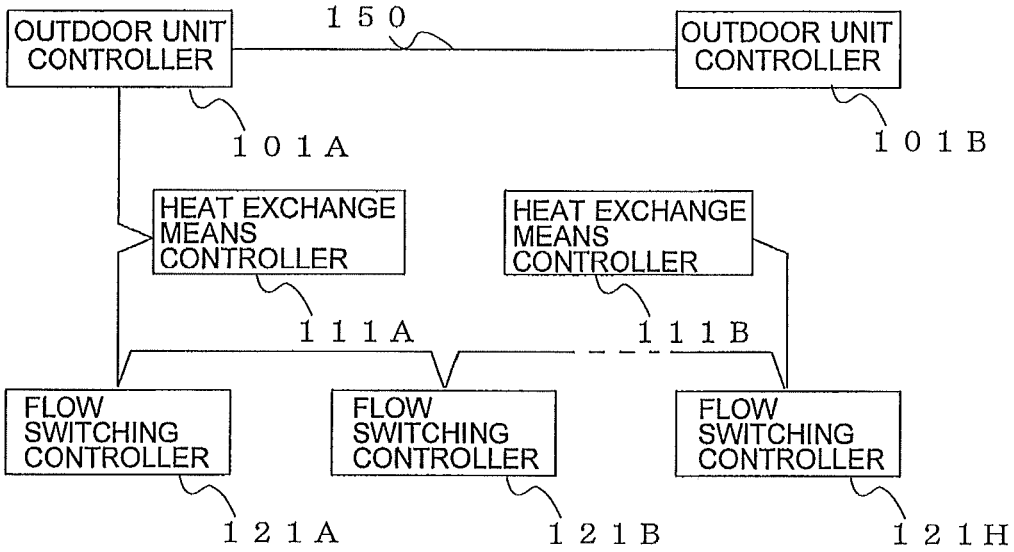

FIG. 9 is a drawing illustrating the communication connection relation of the controller and the like according to the present embodiment.

The air-conditioning apparatus of the present embodiment is constituted of plural devices (units) as shown in FIG. 1. Each device has a controlling unit (in the following, referred to as a controller) comprising a microcomputer to control operation of means mounted within the apparatus. And respective controllers are connected to each other for communication and each one transmits and receives signals and cooperates to perform air-conditioning.

In FIG. 9, the outdoor unit controllers 101-A, 101-B control an action of the means (device, unit, etc.) (for example, driving frequency of the compressor 10, switching of the first refrigerant flow path switching device 11) which the outdoor units 1-A, 1-B have respectively. In addition, the heat exchange means controllers 111-A, 111-B control the action of the means which the heat medium relay units 3-A, 3-B have respectively (for example, driving of the pump 21, opening degree of the expansion device 16, opening and shutting of opening/closing device 17, switching of the second refrigerant flow path switching device 18). Flow path switching controllers 121-A to 121-H control the action of the means which the flow path switching units 6-A to 6-H have respectively (for example, switching of the first heat medium flow path switching device 22, switching of the second heat medium flow path switching device 23, opening degree of the heat medium flow control device 25).

Furthermore, indoor unit controllers 131-A to 131-H control the means relating to the indoor units 2-A to 2-H respectively. In addition, remote controllers 141-A to 141-H are input means for a user to instruct the control set of the operating conditions of the indoor units 2-A to 2-H respectively. Here, respective controllers of the present embodiment shall have memory units (not illustrated) to memorize programs representing the contents of the process which the controllers carries out, data relating to transmission and reception, data such as addresses set to themselves.

And, in the present embodiment, the outdoor unit controller 101, the heat exchange means controller 111 and the flow path switching controller 121 are connected with communication lines 150 of the same system. In addition, operation communication connection lines 160A to 160-H are to connect between the flow path switching controllers 121A to 121-H and the indoor unit controllers 131-A to 131-H respectively. As for the operation communication connection lines 160, for example, 2-bit signals expressing which state of cooling operation state, heating operating state or stopped state as to the indoor unit 2 is in shall be sent from the indoor unit controllers 131 to the flow path switching controllers 121 (there is a case wherein respectively different signals which express operated/stopped, heating/cooling state). Furthermore, exclusive connection lines 170A to 170-H connect between the indoor unit controllers 131-A to 131-H and the remote controllers 141-A to 141-H.

Here, an address space in the communication is defined in the air-conditioning apparatus of the present embodiment. And a unique address (number to distinguish each equipment in communication) is set to each controller connecting with communication lines 150 within the address space. The respective controllers can perform communication identifying the controller from which and to which the communication is to be made by making communication including the address thereof in the signal through communication lines 150. Assuming that the address is set in numerals and the installer sets the address to respective controllers with DIP switch at the time of setting.

Here, the outdoor unit 1-A having an outdoor unit controller 101-A and the heat medium relay unit 3-A having a heat exchange means controller 111-A are connected with a refrigerant piping 4-A. The outdoor unit 1-B having an outdoor unit controller 101-B and the heat medium relay unit 3-B having a heat exchange means controller 111-B are connected with a refrigerant piping 4-B. Besides, the flow path switching unit 6 having a flow path switching controller 121 and the indoor unit 2 having an indoor unit controller 131 are also connected with the heat medium circulation circuit. In FIG. 9(*a*), the respective controllers are connected with communication lines 150 in line with these piping connections, but as in FIG. 9(*b*), for example, the connections are not necessarily in the same form as the piping connections and free connection is possible.

Figure 10:
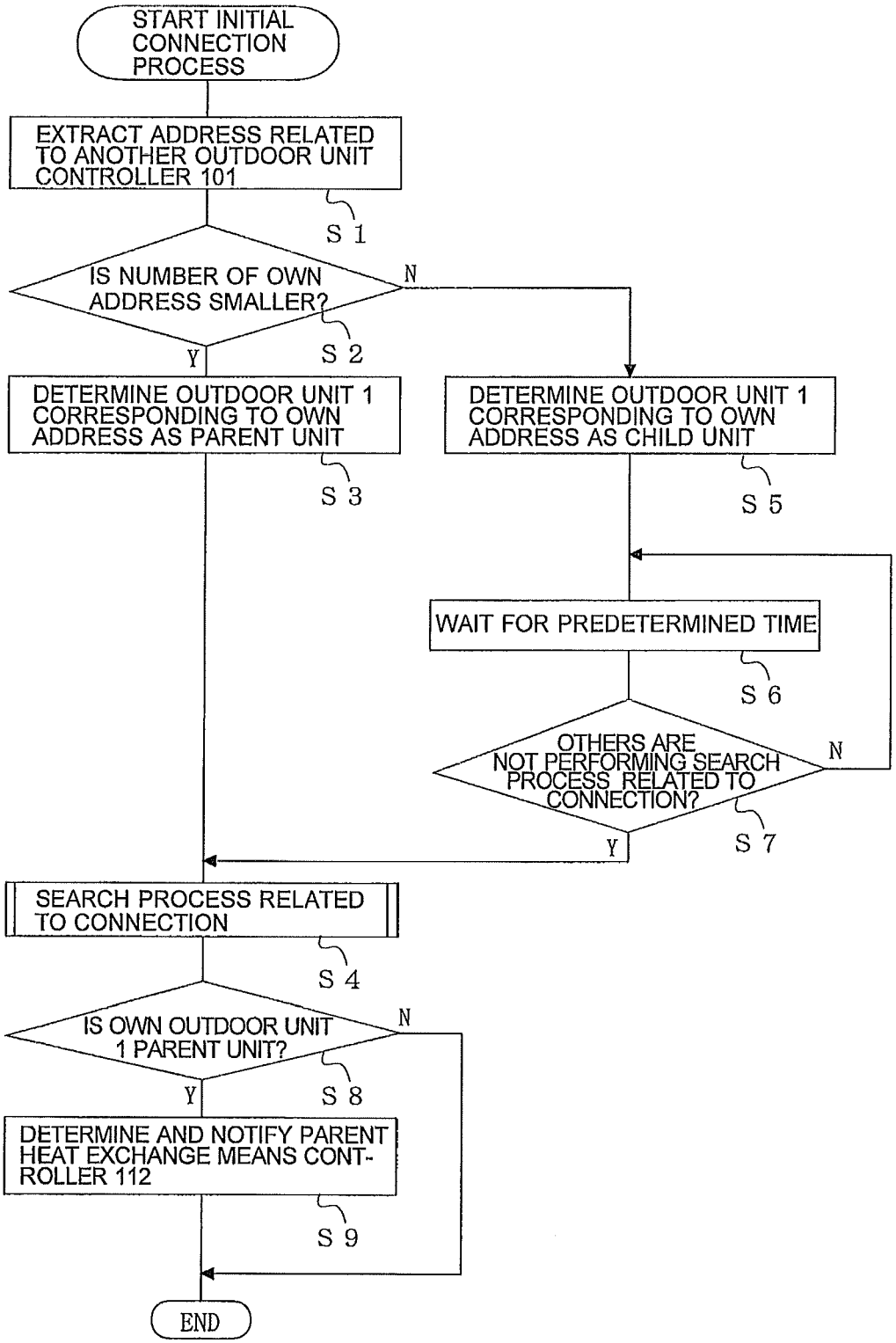
FIG. 10 is a drawing illustrating a flow chart of initial connection processing in the present embodiment.

FIG. 10 is a drawing illustrating a flow chart of initial connection processing in the present embodiment. The initial processing which each outdoor unit controller 101 performs is described based on FIG. 10 to confirm the relation of connection such as the piping in the each unit automatically when the air-conditioning apparatus has been installed in a building and so on. Here, when an initial connection processing is performed, the expansion device 16 in the heat medium relay unit 3, the opening/closing device 17 and the second refrigerant flow path switching device 18 are to be in a state of heating only operation. The pump 21 is not operated but stopped.

At Step S1, each outdoor unit controller 101 judges whether there is an address of another outdoor unit controller 101 within the address space. And when it is judged that there is another outdoor unit controller 101 connected with communication line 150, the address of the outdoor unit controller 101 is extracted and the process advances to Step S2.

At Step S2, the extracted address that other outdoor unit controller 101 has is compared with the address of its own (set to itself). The process advances to Step S3 when it is judged that the number of the address of its own is smaller. The process advances to Step S5 when it is judged that the number of the address of its own is larger.

At Step S3, the outdoor unit 1 in which its own controller is provided is recognized as a parent unit and it is set in memory unit and the process advances to Step S4. At Step S4, each outdoor unit controller 101 performs a search check, and performs a connection relation search processing to determine the heat exchange means controller 111 of the heat medium relay unit 3 connected to the outdoor unit 1 in which its own controller is provided with the refrigerant piping 4 and the process advances to S8. The processing of Step S4 is described later.

In the meantime, at Step S5, the outdoor unit 1 in which its own controller is provided is recognized as a child unit and it is set in memory means and the process advances to Step S6. And, at Step S6, the process waits for a predetermined time and then advances to Step S7. At Step S7, it is judged whether the other outdoor unit controllers 101 do not perform the connection relation search processing. If it is judge that the connection relation search processing is not performed, the process advances to Step S4 and performs the connection relation search processing. If it is judged that the connection relation search processing is performed, the process returns to Step S6.

The outdoor unit controller 101 which has finished the processing of Step S4 advances to Step S8. It is judged whether the outdoor unit 1 in which its own controller is provided is the parent unit at Step S8. The process advances to S9 if it is judged as the parent unit. The initial connection processing is finished if it is judged as not the parent unit (as a child unit).

At Step S9, it is assumed that the outdoor unit controller 101 serving as the parent unit has the heat exchange means controller 111 as the parent heat exchange means controller 112 determined by the connection relation search processing. And the address and the like relating to the parent heat exchange means controller 112 is notified to all controllers connected with the communication lines 150 and the initial connection processing is finished.

Figure 11:
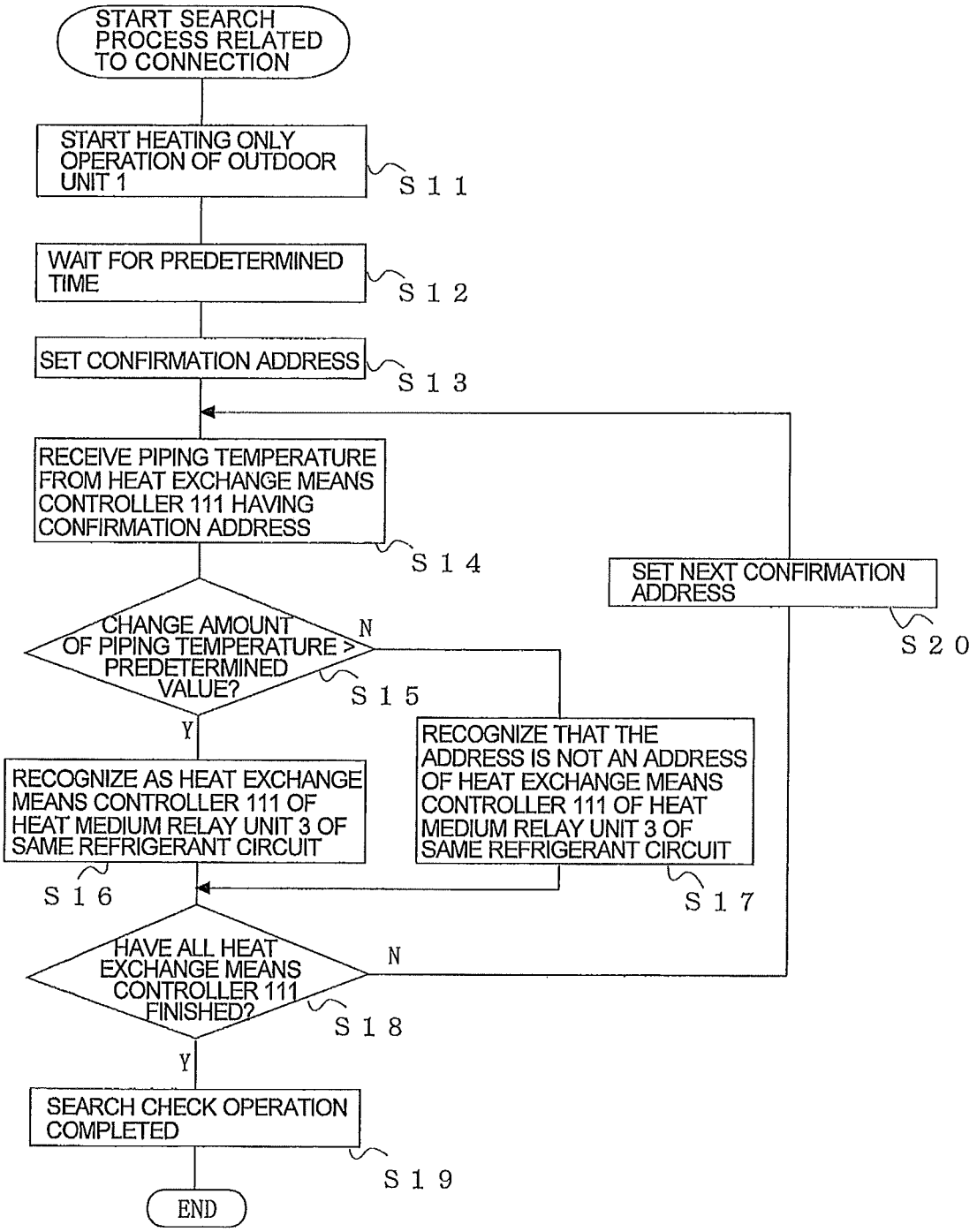
FIG. 11 is a drawing illustrating search processing of the connection relation.

FIG. 11 is a drawing illustrating a flow chart of the connection relation search processing which the outdoor unit controller 101 performs at Step S4 of the initial connection processing. At first at Step S11, each means of the outdoor unit 1 of the control target is controlled to start heating operation and the process advances to Step S12. As mentioned above, the heat medium relay unit 3 is in a condition of heating only operation here. At Step S12, the process waits for a predetermined time and advances to Step S13.

At Step S13, heat medium relay unit 3 having possibility of being connected to the outdoor unit 1 in which its own controller is provided with the refrigerant piping 4 is determined. And, among the addresses which the heat exchange means controllers 111 relating to the determined heat medium relay unit 3 have respectively, the smallest address is set as a confirmation address and the process advances to Step S14. At Step S14, communication is performed with the heat exchange means controller 111 having a confirmation address via communication lines 150. And, for example, a signal including data of the temperature detected at least either one of the second temperature sensors 34 which the heat exchange means controller 111 memorizes (for example, the second temperature sensor 34*c* into which the refrigerant from the heat source 1 firstly flows in heating only operation) is received and the process advances to Step S15.

At Step S15, it is judged whether the amount of change of the temperature of the refrigerant piping 4 is larger than the predetermined value based on the received temperature data. If it is judged to be larger, it is assumed that the heat source side refrigerant flows to the heat medium relay unit 3 through the refrigerant piping 4 by performing heating operation and the process advances to Step S16. The process advances to S17 when it is judged not to be larger (the amount of change is equal to or less than the predetermined value).

At Step S16, the confirmation address is recognized as the address of the heat exchange means controller 111 which the heat medium relay unit 3 in the same refrigerant circuit has and the process advances to Step S18. Here, the process advances to S18 to confirm all the possible heat medium relay units 3 in connection with the combination between the refrigerant circuit and the heat medium circulation circuit, but, for example, the process may advance to S19 and may finish processing after having stopped the heating operation of the outdoor unit 1 in which its own controller is provided.

On the other hand, at Step S17, the confirmation address is recognized not to be the address of the heat exchange means controller 111 which the heat medium relay unit 3 of the same refrigerant circuit has, and it is dismissed and the process advances to Step S18.

At Step S18, it is judged whether the confirmation of all the heat exchange means controller of the same address space which could be connected is completed or not. If it is judged to be completed, the heating operation of the outdoor unit 1 in which its own controller is provided is stopped and the process advances to Step S19. The process advances to S20 if it is judged not to be completed.

At Step S19, it is judged that the search check operation has been completed, the connection relation search processing is finished. At Step S20, among the addresses which the heat exchange means controllers 111 relating to the heat medium relay unit 3 having possibility of being connected to the outdoor unit 1 in which its own controller is provided with the refrigerant piping 4, the largest address except the confirmation address is set as a new confirmation address and the process advances to Step S14.

In this way, each controller connected with communication lines 150 in the air-conditioning apparatus can automatically recognize pipe-connection relation of each outdoor unit 1 and each heat medium relay unit 3 by performing processing initial processing in the initial connection. And preparation to carry out normal operation is set. Here, the heat medium relay unit 3 of the same refrigerant circuit can be confirmed basically by performing connection relation search processing but, for example, abnormality may be informed when the heat medium relay unit 3 of the same refrigerant circuit is not found.

Here, in the present embodiment, relation of connection between the outdoor unit 1 and the heat medium relay unit 3 was automatically recognized by utilizing heating only operation wherein the pipe-connection can be judged by the compressor-discharged refrigerant gas temperature significantly different from the equilibrium temperature, which is the ambient temperature of the refrigerant during the stopped state. For example, when cooling only operation is performed, the system is similarly controllable and can exhibit a similar effect by setting a predetermined value as an amount of change of temperature.

Next is described normal air conditioning control in the air-conditioning apparatus.

For example, sequentially explained is the process wherein signals relating to operation mode set by a remote controller 141 are sent to the indoor unit controller 131 of the corresponding indoor unit 2 and further transmitted from the indoor unit controller 131 to the flow path switching controller 121 of the flow path switching unit 6.

Figure 12:
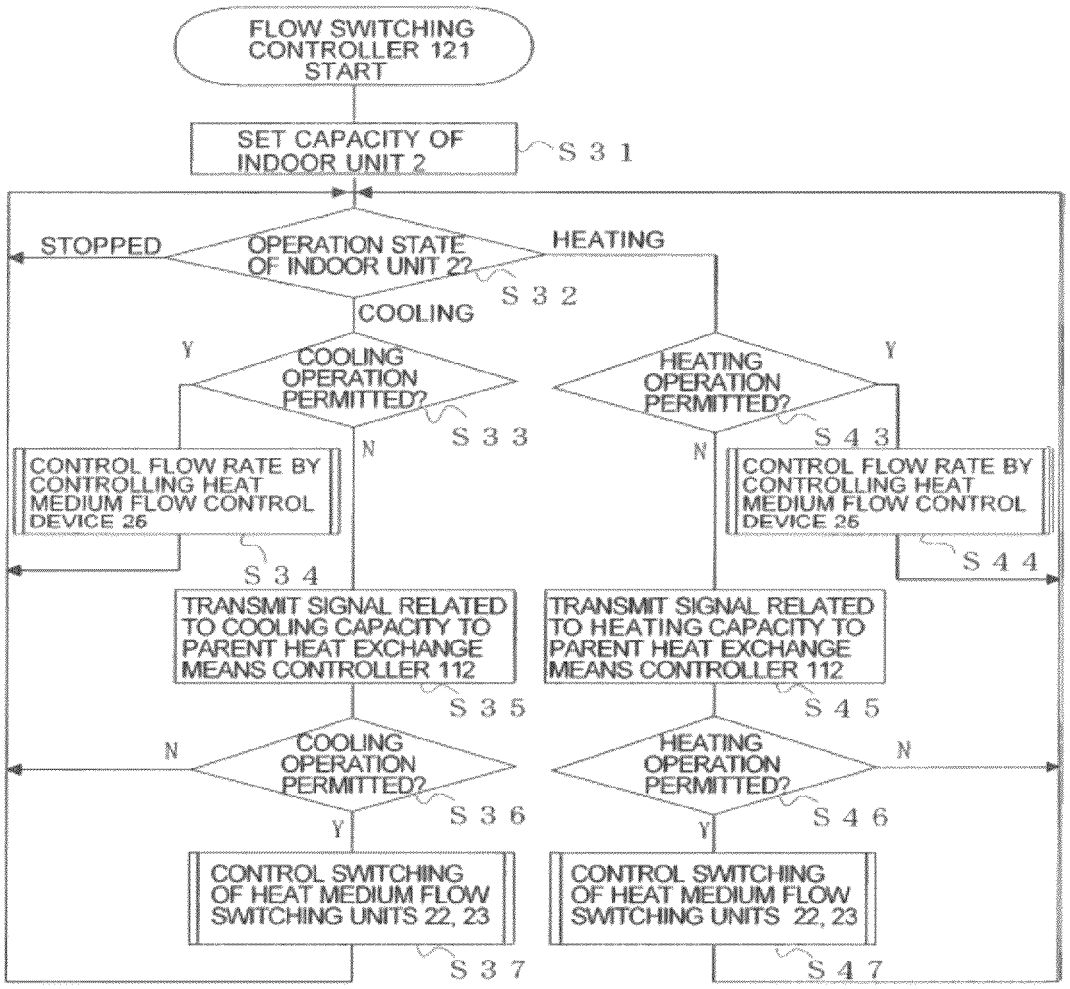
FIG. 12 is a drawing illustrating the processing performed by the flow path switching controller 121.

FIG. 12 is a drawing illustrating a flow chart of the processing performed by the flow path switching controller 121. At Step S31, capacity of the connected indoor unit 2 (capacity relating to the heat exchange of the use side heat exchanger 26) is set and stored beforehand and the process advances to Step S32. The setting method of data relating to the capacity of the flow path switching controller 121 is not limited in particular. For example, various ways can be envisaged such as setting by switches (not illustrated) provided in the flow path switching unit 6, setting by transmission of signals through the operation communication connection line 160.

At Step S32, communication is made with the indoor unit controller 131 through the operation communication connection line 160 to confirm the operating state (state set by the remote controller 141) of the indoor unit 2. If it is confirmed to be stopped, the process returns to Step S32 and, for example, process confirms at every scheduled time. On the other hand, the process advances to S33 if it is confirmed to be cooling operation. In the meantime, the process advances to S43 if it is confirmed to be heating operation. Here, as mentioned above, as for the operating state of the indoor unit 2, 2-bit signals expressing operated/stopped and heating/cooling state is sent via the operation communication connection line 160.

At Step S33, it is judged whether the cooling operation is permitted in the parent heat exchange means controller 112. The process advances to S34 if it is judged to be permitted. The process advances to S35 if it is judged to be not permitted. At Step S34, the heat medium flow control device 25 is controlled and the process returns to Step S32. Here, adjustment of the quantity of the heat medium by the heat medium flow control device 25 is made for the temperature of the heat medium so that the opening degree may be the degree corresponding to the cooling capacity needed by the indoor unit 2 (use side heat exchanger 26) connected to the flow path switching unit 6 in which its own controller is provided.

At Step S35, signals relating to the cooling capacity are sent to the parent heat exchange means controller 112 through the communication line 150 and the process advances to Step S36. At Step S36, it is judged whether permission for operation has been obtained by the parent heat exchange means controller 112 or not. The process advances to S37 if it is judged that permission has been obtained whereas the process returns to Step S32 if it is judged that permission has not been obtained. At Step S37, switching of the heat medium flow path switching devices 22, 23 is controlled so that heat medium relating to cooling may be flowed into and out the indoor unit 2 and, then the process returns to Step S32.

Step S43, it is judged whether heating operation is permitted in the parent heat exchange means controller 112 or not. The process advances to S44 if it is judged to be permitted. The process advances to S45 if it is judged not to be permitted. At Step S44, the heat medium flow control device 25 is controlled and the process returns to Step S32. Here, adjustment of the quantity of the heat medium by the heat medium flow control device 25 is made for the temperature of the heat medium so that the opening degree may be the degree corresponding to the heating capacity needed by the indoor unit 2 (use side heat exchanger 26) connected to the flow path switching unit 6 in which its own controller is provided.

At Step S45, signals relating to the heating capacity are sent to the parent heat exchange means controller 112 through the communication line 150 and the process advances to Step S36. At Step S46, it is judged whether permission for operation has been obtained by the parent heat exchange means controller 112 or not. The process advances to S47 if it is judged that permission has been obtained whereas the process returns to Step S32 if it is judged that permission has not been obtained. At Step S47, switching of the heat medium flow path switching units 22, 23 is controlled so that heat medium relating to heating may be flowed into and out the indoor unit 2 and, then the process returns to Step S32.

Figure 13:
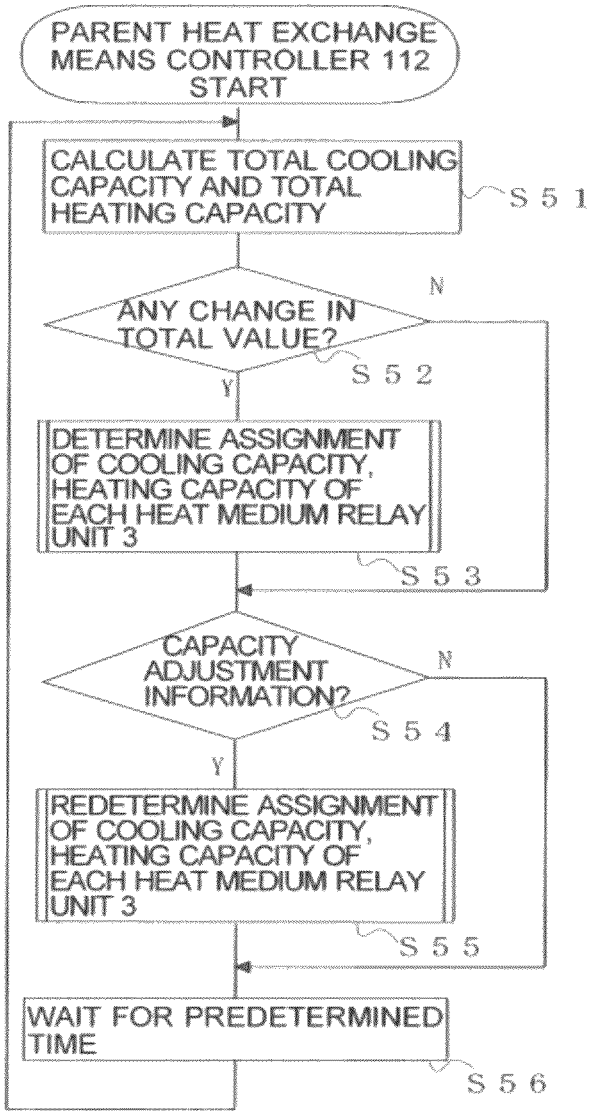
FIG. 13 is a drawing illustrating the processing performed by the heat exchange means controller 112.

FIG. 13 is a drawing illustrating a flow chart of the processing performed by the heat exchange means controller 112. This processing is a special processing which the parent heat exchange means controller 112 determined by the initial connection processing performs. At Step S35 or S45 mentioned above, each flow path switching controller 121 transmits signals relating to the cooling capacity or heating capacity. At Step S51, cooling capacity and heating capacity, which are obtained, for example, as numerical data are respectively summed up based on the signals from respective flow path switching controllers 121 to calculate and determine the total cooling capacity and the total heating capacity and the process advances to Step S52. At Step S52, it is judged whether there has been a change in the total of the determined total cooling capacity and total heating capacity. The process advances to S53 if it is determined that there is a change. The process advances to S54 if it is determined that there is not a change.

At Step S53, assignment of the cooling capacity, heating capacity which each heat medium relay unit 3 supplies to the heat medium is determined and the process advances to Step S54. Here, the following should be considered as a concept of the assignment. For example, cooling capacity and heating capacity are assigned to a certain heat medium relay unit 3 by cooling main operation or heating main operation so that the cooling capacity and heating capacity of the same capacity are supplied. And either one of the cooling capacity and heating capacity remained by assignment is assigned so that it may be supplied to another heat medium relay unit 3 by cooling only operation or heating only operation. In addition, assignment is performed so that the capacity may be supplied to each heat medium relay unit 3 in such a frequency with operation efficiency as high as possible in consideration of the relationship between the operation frequency and efficiency of the compressor 10 of the outdoor unit 1. It is necessary to consider so that change of the capacity may be as little as possible in consideration of the situation of assignment of the capacity before the decision at this time so as to evade capacity reduction due to transitional phenomenon, and it is a matter to preferentially consider on the occasion of the assignment decision mentioned above.

For example, in the case wherein 50% operation is the most efficient in the outdoor unit 1, when it suffices to supply capacity to the load of one air-conditioning apparatus×100% as a whole, the cooling capacity, heating capacity are assigned so that two outdoor units 1 may be operated. In addition, when capacity is to be supplied to the load of one outdoor unit× 150% of the cooling capacity and one outdoor unit×50% of the heating capacity, 50% of cooling and 50% of heating are assign to one outdoor unit to perform cooling main operation or heating main operation. And cooling capacity and heating capacity are assigned so that 50% cooling may be assigned to another outdoor unit to perform cooling only operation.

This is highly efficient by utilizing waste heat in cooling and heating mixed operation but difference in pressure increases for cooling only operation and heating only operation from a high pressure and a low pressure condition of the heat source side refrigerant. On this account, as for the disequilibrium share of the cooling capacity, heating capacity, due to somewhat larger input of the heat source side refrigerant to the compressor 10, it becomes effectively advantageous to supplement the capacity by cooling only operation or heating only operation.

The air-conditioning apparatus of the present embodiment has plural refrigerant circuits, and they can be operated with the pressures in the respective refrigerant circuits being in individual conditions. In addition, when the capacity is supplied to the load, it is performed via a heat medium and thereby the capacity (heat capacity) to supply in a plural number of systems can be summed up to supply the heat medium and further assignment from the heat medium to the use side heat exchanger 26 of each indoor unit 2 is enabled. Based upon the above, the control in consideration of operation efficiency or the like may be realized by the constitution of the air-conditioning apparatus of the present embodiment.

At Step S54, it is judged whether a signal including the capacity adjustment information has been transmitted from the outdoor unit controller 111 of each outdoor unit 1 via each heat exchange means controller 111. The process advances to S55 when it is determined that a signal is transmitted. When it is determined that a signal is not transmitted, the process skips to S56. Here, the capacity adjustment information as used in the present embodiment is information to express eight kinds of states: cooling capacity>heating capacity (with waste-heat of the heating capacity), cooling capacity<heating capacity (with waste-heat of the cooling capacity), cooling capacity upper limit (operation efficiency degraded), heating capacity upper limit (operation efficiency degraded), operation by larger capacity than the most suitable operation, operation by smaller capacity than the most suitable operation, defrost operation, operation being impossible.

At Step S55, cooling capacity and heating capacity to assign to the heat medium relay unit 3 are re-determined based on each capacity adjustment information and signals relating to the determination are transmitted to each heat exchange means controller 111 which each heat medium relay unit 3 has and then the process advances to Step S56.

When the re-determination is made, for example, in the case wherein it is judged as cooling capacity>heating capacity based on the capacity adjustment information, it is considered to add a heating capacity which has been assigned to the other heat medium relay units 3 or to shift a cooling capacity which has been assigned to the heat medium relay units 3 to the other heat medium relay units 3. In the meantime, when it is judged as cooling capacity<heating capacity, it is considered to add a cooling capacity which has been assigned to the other heat medium relay units 3 or to shift a heating capacity which has been assigned to the heat medium relay units 3 to the other heat medium relay units 3.

When it is judged as the cooling capacity upper limit, it is considered to shift a cooling capacity which has been assigned to the heat medium relay units 3 to the other heat medium relay units 3. When it is judged as the heating capacity upper limit, it is considered to shift a heating capacity which has been assigned to the heat medium relay units 3 to the other heat medium relay units 3.

In the meantime, when it is judged as operation by larger capacity than the most suitable operation, it is considered to shift a cooling capacity or heating capacity to the other heat medium relay units 3. When it is judged as operation by smaller capacity than the most suitable operation, it is considered to add a cooling capacity or heating capacity which has been assigned to the other heat medium relay units 3.

When it is judged as defrost operation, heating capacity is shifted to the other heat medium relay units 3 and special operation condition (stopping the pump 21, fully opening the expansion device 16) is realized in the heat medium relay unit 3. And when it is judged as operation being impossible, no capacity is assigned to the heat medium relay unit 3.

Here when there are plural contradicting pieces of capacity adjustment information, judgment is to be made in the priority order of operation being impossible→defrost operation→cooling capacity<heating capacity→cooling capacity>heating capacity→heating capacity upper limit→cooling capacity upper limit→operation by larger capacity than the most suitable operation→operation by smaller capacity than the most suitable operation.

This priority order is to make much of the stability supply of the capacity relating to air-conditioning. And it is taken into consideration that the information of cooling capacity<heating capacity, heating capacity upper limit is applied like a dummy to evade defrost.

At Step S56, the process waits for a predetermined time and advances to Step S51. As described above, the parent heat exchange means controller 112 performs processing of assigning cooling capacity, heating capacity to each heat medium relay unit 3 (heat exchange means controller 111).

Figure 14:
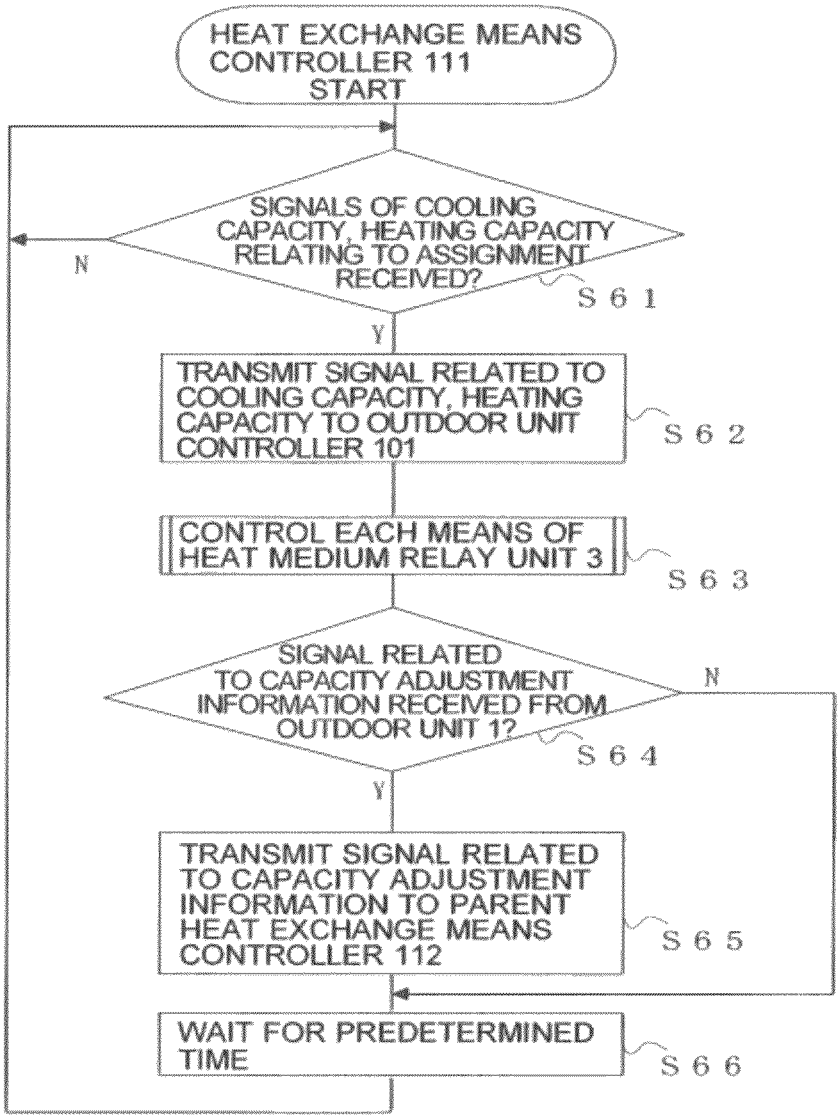
FIG. 14 is a drawing illustrating the processing performed by the heat exchange means controller 111.

FIG. 14 is a drawing illustrating a flow chart of the processing which the heat exchange means controller 111 performs. Here, the parent heat exchange means controller 112 is included in the heat exchange means controller 111. At Step S61, it is confirmed whether signals of cooling capacity, heating capacity relating to assignment have been received from parent heat exchange means controller 112 and the process advances to Step S62. At Step S62, signals of cooling capacity, heating capacity relating to assignment are transmitted to the corresponding outdoor unit controller 101 and the process advances to Step S63.

At Step S63, control of each means of the heat medium relay unit 3 in which its own controller is provided is performed so that cooling capacity, heating capacity relating to assignment may be supplied to the heat medium and the process advances to Step S64. For example, the pump 21 pressurizes the heat medium in accordance with the inlet/outlet temperature of the heat medium side of the heat exchanger 15 related to heat medium such as the first temperature sensor 31. In addition, the expansion device 16 controls the opening degree in accordance with the situation of the heat source side refrigerant as an index of SH (superheat) and SC (subcool). The pump 21 is stopped and the expansion device 16 is fully opened at the time of the defrost operation as mentioned above.

It is judged whether signals relating to the capacity adjustment information mentioned above have been received from the outdoor unit 1 at Step S64. The process advances to S65 if it is judged that the signals relating to capacity adjustment information have been received. The process skips to Step S66 if it is judged that the signals relating to capacity adjustment information have not been received. At Step S65, the received signals relating to capacity adjustment information are transmitted to the parent heat exchange means controller 112. In the meantime, at Step S66, the process waits for a predetermined time and then returns to Step S61.

Figure 15:
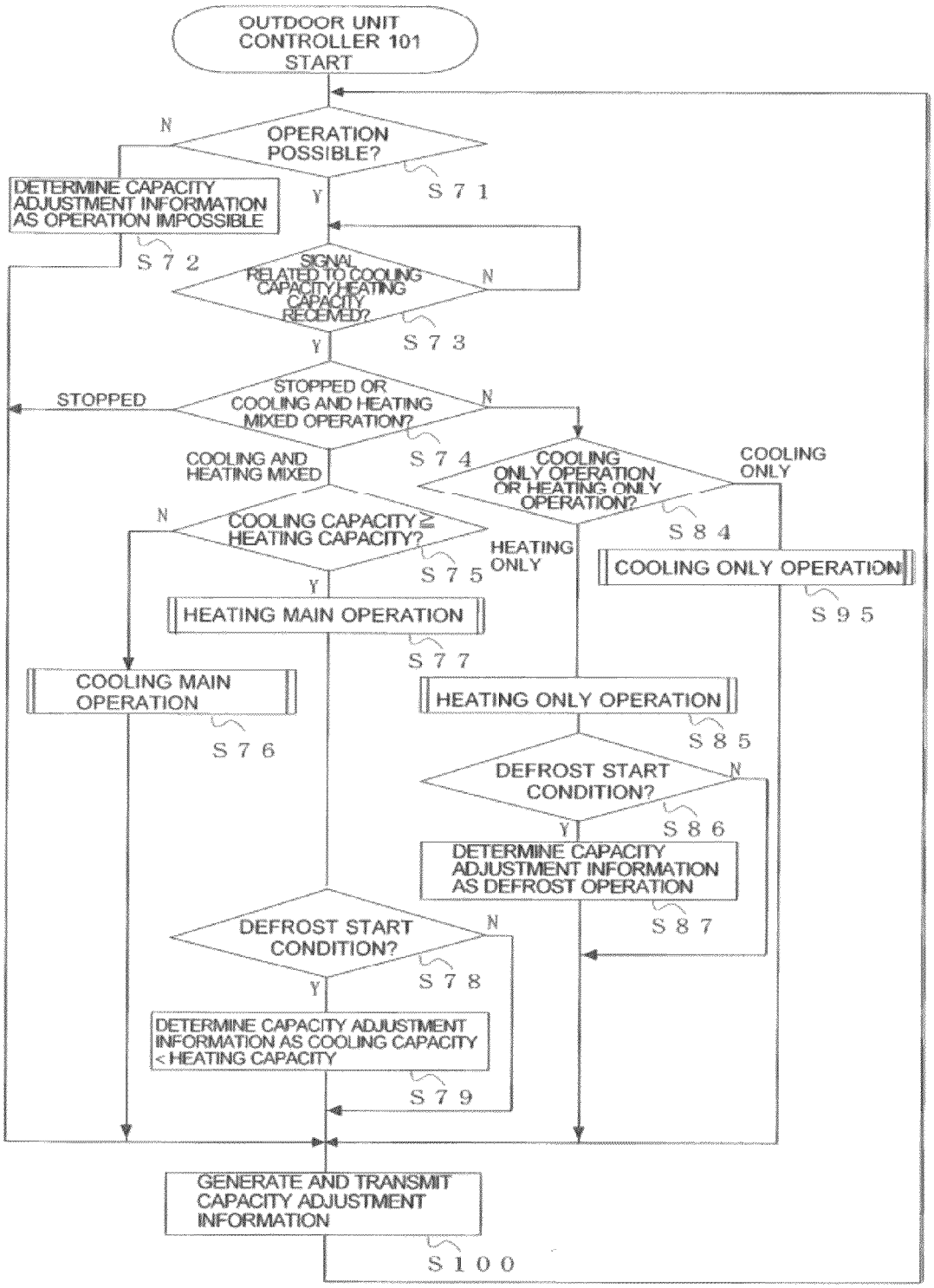
FIG. 15 is a drawing illustrating the processing performed by the outdoor unit controller 101.

FIG. 15 is a drawing illustrating a flow chart of the processing which the outdoor unit controller 101 performs.

At Step S71, it is judged whether operation is possible. The process advances to S73 if the operation is judged to be possible. The process advances to S72 if the operation is judged to be impossible. At Step S72, the capacity adjustment information is temporarily determined as operation being impossible and the process advances to Step S100.

At Step S73, the input (reception) of signals relating to cooling capacity, heating capacity transmitted from the heat exchange means controller 111 connected by a refrigerant circuit are confirmed and the process advances to Step S74. At Step S74, it is judged whether the state of the outdoor unit 1 is a state of operation being stopped, cooling and heating mixed operation or a state neither of them (cooling only operation, heating only operation). The process advances to S75 if it is judged as cooling and heating mixed operation. The process skips to Step S100 if it is judged as stop. In the meantime, the process advances to S84 if it is judged neither of them.

At Step S75, it is judged which is larger the cooling capacity or the heating capacity from the heat exchange means controller 111 is. The process advances to S76 when it is judged that the cooling capacity is larger than the heating capacity. The process advances to S77 when it is judged that the cooling capacity is not larger than the heating capacity (the cooling capacity is smaller than the heating capacity). At Step S76, the outdoor unit 1 in which its own controller is provided is made to perform the cooling main operation and the process advances to Step S100. At Step S77, the outdoor unit 1 in which its own controller is provided is made to perform the heating main operation and the process advances to Step S78.

At Step S78, it is judged whether the predetermined defrost start condition relating to the heating main operation is reached. The process advances to S79 if it is judged that the defrost start condition is reached. The process skips to Step S100 if it is judged that the defrost start condition is not reached. At Step S79, although the capacity adjustment information is inherently defrost operation, the capacity adjustment information is temporarily determined as cooling capacity<heating capacity as a dummy to evade defrost operation for the purpose of having it permitted to shift to cooling main operation, and the process advances to Step S100. Thereby, for example, when the parent heat exchange means controller 111 performs reassignment based on the capacity adjustment information, capacity is assigned to the other heat source unit 1 (refrigerant circuit) to be able to perform the cooling main operation. On this account, the heat source side heat exchanger 12 of the outdoor unit 1 is allowed to function as a condenser and defrost is performed while the process is allowed to supply heating capacity and cooling capacity.

At Step S84, it is judged in which condition of heating only operation or cooling only operation the outdoor unit 1 is. The process advances to S85 if determined to be heating only operation. Furthermore, the process advances to S95 if determined to be cooling only operation. Here, defrost operation is included in the heating only operation.

At Step S85, the outdoor unit 1 in which its own controller is provided is made to perform the heating only operation and the process advances to Step S86. At Step S86, it is judged whether the predetermined defrost start condition relating to the heating only operation is reached. The process advances to S87 if it is judged that the defrost start condition is reached. The process skips to Step S100 if it is judged that the defrost start condition is not reached. At Step S87, the capacity adjustment information is temporarily determined as defrost operation and the process advances to Step S100.

At Step S95, the outdoor unit 1 in which its own controller is provided is made to perform the cooling only operation and the process advances to Step S100.

At Step S100, capacity adjustment information in the outdoor unit 1 is generated while taking priority of the temporary determination at Step S72, Step S79 and Step S87. And the signals relating to capacity adjustment information are transmitted to the corresponding heat exchange means controller 111 and the processing is finished.

As described above, according to the air-conditioning apparatus of the present embodiment, plural refrigerant circuits (refrigerating cycle systems) are connected to a heat medium circulation circuit (heat medium side system) and cooling capacity, heating capacity can be supplied to the heat medium circulating through the heat medium circulation circuit individually from each refrigerant circuit, and therefore, enhancement of the supplied capacity can be performed easily. In addition, communication can be performed among the outdoor unit controller 101, the heat exchange means controller 111, the flow path switching controller 121 and collaborated control among the plural refrigerant circuits can be performed and thus each heat source unit 1 share the capacity. On this account, each heat source unit 1 performs the most suitable operation effectively, and thus, for example, energetically efficient operation can be performed as a whole air-conditioning apparatus.

For example, in the case of operation by a small capacity (operation in which cooling capacity, heating capacity to supply may be small), two outdoor units do not have to be operated at the same time, and one outdoor unit 1 can be operated under a condition where the compressor 10 is operated with good operation efficiency. In addition, in the case of a condition where one outdoor unit 1 is operated in the vicinity of the greatest capacity, two outdoor units 1 can share the capacity to supply and can be operated under a condition where the compressor 10 is operated with good operation efficiency.

Furthermore, when plural indoor units 2 perform cooling operation and heating operation respectively, in order to avoid waste heat in the heat source side heat exchanger 12 and to improve efficiency, cooling capacity and heating capacity in respective indoor units 2 can be added up, then capacities can be assigned to one of the two systems of the refrigerant circuits based on the totalized capacities so that cooling capacity and heating capacity may be supplied at the same level, and the remaining capacity of the totalized capacities is supplied to the refrigerant circuit of the other system and thus cooperative operation can be achieved by such a combined operation. Efficiency can be achieved by controlling the operation as mentioned above.

In addition, since respective refrigerant circuits are independent from each other, even if a certain outdoor unit 1 (heat medium relay unit 3) stops and cannot be operated, operation can be continued by the other outdoor units 1. On this account, for example, maintenance to shut down the power supply individually can be carried out easily. This also holds good at the time of adding a unit to the system. In addition, when defrost start condition is satisfied by frosting of the heat source side heat exchanger 12 in the outdoor unit 1 in the heating main operation, cooling capacity, heating capacity can be assigned to the other refrigerant circuits to switch to cooling main operation or the like and thus defrost operation can be evaded.

Besides, since respective refrigerant circuits are independent from each other and the heat medium circulation circuits join together, there is little limitation on the setting position of the units of the refrigerant circuit side (outdoor units 1 and heat medium relay units 3). On this account, distributed setting is possible, and the system construction effectively utilizing empty space (including the case of adding on something to the system) is easy.

In addition, a single system of transmission line for the refrigerant piping part of the outdoor unit 1 and the heat medium relay unit 3 is sufficient even in plural refrigerant circuits and thus an effect of saving construction is provided. Furthermore, when the flow path switching unit 6 and the indoor unit 2 are disposed in the vicinity with each other, the feature that there are heat medium always having heating energy and heat medium always having cooling energy at the time of the cooling and heating mixed operation can be utilized, and, for example, heat medium relating to the cooling energy and the heating energy can be immediately flowed into the indoor unit 2 when cooling and heating are switched, and thereby an effect of improving the comfort of air-conditioning of indoor temperature can be obtained. At this time, heat amount which should be heated or cooled upon the switching of the heating energy and cooling energy as a heat medium is only a part of the heat medium present in the flow path switching unit 6 and the indoor unit 2, and accordingly, excessive heat amount necessary for switching is small and energy saving can be achieved. And since the flow path switching unit 6 is independent from the heat medium relay unit 3, a flow path switching unit 6 can be easily installed which is suitable for the indoor unit 2. On this account, for example, the general-purpose indoor unit 2 can be controlled in cooperation with other units through the flow path switching unit 6, and thus an effect that a general purpose product can be utilized as an indoor unit 2 is obtained.

Furthermore, since the outdoor unit controller 101 controlling the outdoor unit 1 can communicate with the heat exchange means controller 111 via the communication line 150, for example, relation of connection in the refrigerant circuits can be recognized automatically by judging the heat medium relay unit 3 which produces temperature change more than the predetermined value when the outdoor unit 1 in which its own controller is provided is operated during the initial processing at the time of the setting. In addition, since the relation of connection can be recognized automatically in the refrigerant circuit, there is no need to adjust relation of connection of communication line 150 to the refrigerant piping connection, and thus degree of freedom can be enhanced. On this account, for example, a single system of communication line can be used as the communication line between the outdoor unit 1 and the heat medium relay unit 3 in which the communication line 150 may be long.

Embodiment 2

Two system refrigerant circuits are connected the heat medium circulation circuit in the above-mentioned embodiment, but the present invention is not limited to this. More than 2 system refrigerant circuits may be connected.

REFERENCE SIGNS LIST

1, 1-A, 1-B outdoor unit,
2, 2-A to 2-H indoor unit,
3, 3-A, 3-B heat medium relay unit,
4, 4-A, 4-B refrigerant piping,
5 piping,
6, 6-A to 6-H flow path switching unit,
10 compressor,
11 four-way switching valve (first refrigerant flow path switching device),
12 heat source side heat exchanger,
13*a*, 13*b*, 13*c*, 13*d* check valve,
15, 15*a*, 15*b* heat exchanger related to heat medium,
16, 16*a*, 16*b* expansion device,
17, 17*a*, 17*b* opening/closing device,
18, 18*a*, 18*b* second refrigerant flow path switching device,
19 accumulator,
21, 21*a*, 21*b* pump (heat medium sending device),
22, 22-A to 22-D heat medium flow path switching device,
23, 23-A to 23-D heat medium flow path switching device,
25, 25-A to 25-D heat medium flow control device,
26, 26-A to 26-H use side heat exchanger,
31*a*, 31*b* first temperature sensor,
34*a*, 34*b*, 34*c*, 34*d* second temperature sensor,
35, 35-A to 35-D third temperature sensor,
36 pressure sensor,
101, 101-A, 101-B outdoor unit controller,
111, 111-A, 111-B heat exchange means controller,
112 parent heat exchange means controller
121, 121-A to 121-H flow path switching controller,
131, 131-A to 131-H indoor unit controller,
141, 141-A to 141-H remote controller.

The invention claimed is:

1. An air-conditioning apparatus comprising:

at least two outdoor units, each having a compressor, a first refrigerant flow path switching device and a heat source side heat exchanger;

at least two heat medium relay units, each heat medium relay unit having, arranged in a refrigerant flow path, at least two second refrigerant flow path switching devices, at least two heat exchangers related to heat medium, a first opening/closing valve, a second opening/closing valve, expansion devices and at least two pumps;

at least two indoor units, each having a use side heat exchanger;

at least two flow path switching units having heat medium flow path switching devices;

at least two refrigerating cycle systems arranged between each outdoor unit and a respective heat medium relay unit, each refrigerating cycle system respectively connecting the compressor for compressing a refrigerant, the refrigerant flow path switching device for switching the circulation path of the refrigerant, the heat source side heat exchanger for exchanging heat for the refrigerant, the expansion devices for adjusting the pressure of the refrigerant, and the heat exchangers related to heat medium which exchange heat between the refrigerant and the heat medium different from the refrigerant to be able to make the heat medium different in temperature respectively, by piping so as to constitute refrigerant circuits; and at least two heat medium side systems each respectively connecting the at least two pumps for circulating the heat medium for the at least two heat exchangers related to heat medium, the use side heat exchangers for exchanging heat between the heat medium and air of an air-conditioning target space and the heat medium flow switching devices for switching the heat medium which has passed through the at least two heat exchangers related to heat medium to the use side heat exchangers, by piping so as to constitute a heat medium circulation circuit, wherein the heat medium circulation circuit is constituted such that each of the use side heat exchangers in the at least two indoor units is capable of communicating with each of the heat exchangers related to heat medium constituting the at least two refrigerating cycle systems, and the air-conditioning apparatus further comprises a controller configured to, based on total values of each cooling capacity and heating capacity, the cooling capacity and the heating capacity each being necessary to the heat medium for a load related to each heat exchange of the use side heat exchangers, determine the number of compressors needed for supplying the totalized cooling capacity and the totalized heating capacity when the compressors operate with the maximum operation efficiency, and operate the determined number of the refrigerating cycle systems.

2. The air-conditioning apparatus according to claim 1, wherein a check valve is provided at each pump outlet side for preventing reverse flow against a flow direction of the heat medium.

3. The air-conditioning apparatus according to claim 1, wherein the at least two outdoor units, the at least two heat medium relay units, and the at least two flow path switching units have controllers, respectively, that are connected to communicate with a same communication system.

4. The air-conditioning apparatus according to claim 1, wherein on the basis of the total values, the controller is configured to assign to each refrigerating cycle system, the cooling capacity and the heating capacity being supplied to the heat medium.

5. The air-conditioning apparatus according to claim 4, wherein the controller is configured to assign heating and cooling capacity among the at least two refrigerant cycle systems so that when the cooling capacity and the heating capacity, which are supplied to the heat medium, are assigned to the at least two refrigerating cycle systems, cooling capacity and heating capacity are assigned to at least one refrigerating cycle system so as to avoid waste heat in the corresponding heat source side heat exchanger and to be supplied from the refrigerating cycle system and a last remaining excessive part of either the cooling capacity or the heating capacity is assigned to a refrigerating cycle system other than the at least one refrigerating cycle system.

6. The air-conditioning apparatus according to claim 3, wherein the controllers which the at least two outdoor units have are configured to operate the respective outdoor unit to be controlled and communicate with a corresponding heat medium relay unit of the at least two heat medium relay units, and configured to perform connection confirmation processing, the connection confirmation processing determining that the corresponding heat medium relay unit constitute the same refrigerant circuit when an amount of a change of temperature of the refrigerant passing through the corresponding heat medium relay unit is equal to or more than a predetermined value.

* * * * *